US008684107B2

(12) United States Patent
Clark

(10) Patent No.: US 8,684,107 B2
(45) Date of Patent: Apr. 1, 2014

(54) SYSTEM AND METHOD FOR DENSELY PACKING WELLS USING MAGNETIC RANGING WHILE DRILLING

(75) Inventor: Brian Clark, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 261 days.

(21) Appl. No.: 12/992,984

(22) PCT Filed: Feb. 2, 2009

(86) PCT No.: PCT/US2009/032796

§ 371 (c)(1),
(2), (4) Date: Nov. 16, 2010

(87) PCT Pub. No.: WO2009/142782

PCT Pub. Date: Nov. 26, 2009

(65) Prior Publication Data

US 2011/0079431 A1 Apr. 7, 2011

Related U.S. Application Data

(60) Provisional application No. 61/055,721, filed on May 23, 2008.

(51) Int. Cl.
*E21B 47/022* (2012.01)

(52) U.S. Cl.
USPC ..... 175/24; 175/45

(58) Field of Classification Search
USPC ..... 175/24, 40, 45; 324/346
See application file for complete search history.

(56) References Cited

U.S. PATENT DOCUMENTS

| | | | | |
|---|---|---|---|---|
| 4,443,762 | A * | 4/1984 | Kuckes | 324/346 |
| 4,593,770 | A * | 6/1986 | Hoehn, Jr. | 175/45 |
| 5,589,775 | A * | 12/1996 | Kuckes | 324/346 |
| 5,676,212 | A | 10/1997 | Kuckes | |
| 5,923,170 | A * | 7/1999 | Kuckes | 324/326 |
| 6,736,221 | B2 | 5/2004 | Chia et al. | |
| 7,703,548 | B2 | 4/2010 | Clark | |
| 7,812,610 | B2 | 10/2010 | Clark et al. | |
| 8,011,451 | B2 * | 9/2011 | MacDonald | 175/61 |
| 2003/0014873 | A1 | 1/2003 | Towle | |
| 2003/0085059 | A1 * | 5/2003 | Kuckes et al. | 175/45 |
| 2005/0178542 | A1 | 8/2005 | Lima et al. | |
| 2006/0028321 | A1 * | 2/2006 | Kennedy et al. | 340/385.1 |
| 2006/0131013 | A1 | 6/2006 | McElhinney | |
| 2007/0126426 | A1 | 6/2007 | Clark et al. | |
| 2008/0041626 | A1 | 2/2008 | Clark | |
| 2009/0030615 | A1 | 1/2009 | Clark | |
| 2009/0260879 | A1 * | 10/2009 | Clark et al. | 175/45 |
| 2010/0271232 | A1 | 10/2010 | Clark et al. | |

FOREIGN PATENT DOCUMENTS

| | | | |
|---|---|---|---|
| WO | 2008067976 | A1 | 6/2008 |
| WO | WO2009014838 | | 1/2009 |

* cited by examiner

*Primary Examiner* — Daniel P Stephenson
(74) *Attorney, Agent, or Firm* — Kimberly Ballew

(57) ABSTRACT

Systems and methods for drilling a plurality of densely packed wells to efficiently utilize available drilling space. In accordance with one embodiment, a method of drilling densely packed wells may include drilling a second well using magnetic ranging while drilling to control a distance between the second well and a first well (the first well being either existing or drilled immediately prior to starting to drill the second well), and drilling a third well using magnetic ranging while drilling to control a distance between the third well and the first and second wells.

20 Claims, 29 Drawing Sheets

SYSTEM AND METHOD FOR DENSELY PACKING WELLS USING MAGNETIC RANGING WHILE DRILLING

BACKGROUND OF THE INVENTION

The present invention relates generally to well drilling operations and, more particularly, to well drilling operations using magnetic ranging while drilling to reduce the footprint of drilling operations and/or efficiently utilize available space by densely packing wells.

In many drilling operations, it may be necessary or desirable to closely space a plurality of wells to reduce environmental impact and/or to efficiently utilize available space. For example, space is generally at a premium on offshore production platforms because there is a limited area available for wellheads. Accordingly, the wells are typically packed together in a closely spaced configuration. Indeed, such platforms typically include many closely spaced wells that extend vertically under the platform to a certain depth before branching out into deviated and horizontal trajectories. The region under the platform wherein the wells are closely spaced may extend for a substantial distance (e.g., several hundred meters) before a "kick-off" point, where the wells deviate and extend away from the tightly spaced region.

Including a large number of wells in a small space, such as the closely spaced region beneath the offshore platform discussed above, can increase the potential for collisions between a drill bit and an existing well. Thus, wells are generally separated by a safe minimum distance to avoid or substantially reduce the risk of such collisions. Hence, the number of wells (or "slots") that can be accommodated within a defined area (e.g., a platform) is generally limited by uncertainties in the wells' trajectories in the formation. Traditionally, uncertainties in the positions of existing wells and the uncertainty in the drill bit position are related to the accuracy of measurement while drilling (MWD) and direction and inclination (D&I) measurements. With conventional practice, uncertainty in well position increases as the depth of the well increases, which defines an ellipse of uncertainty. This uncertainty arises from the limited accuracy of the MWD and D&I measurements, and from the limited accuracy of any wireline surveys that might have been performed after the wells were cased.

BRIEF DESCRIPTION OF THE DRAWINGS

Advantages of the present embodiment may become apparent upon reading the following detailed description and upon reference to the drawings in which.

DETAILED DESCRIPTION OF SPECIFIC EMBODIMENTS

One or more specific embodiments of the present invention are described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
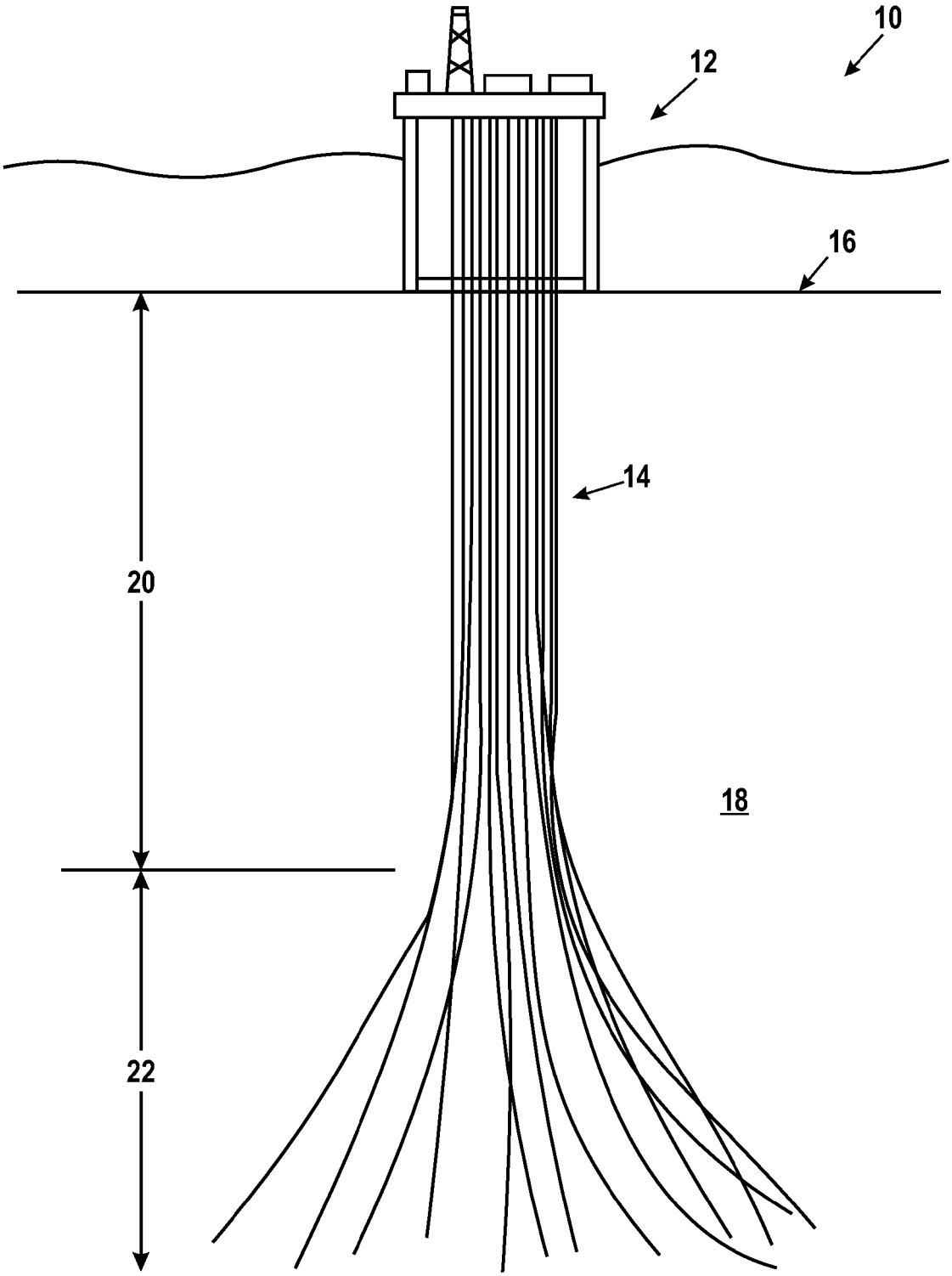
FIG. 1 illustrates a well drilling operation involving drilling a plurality of densely packed wells using magnetic ranging while drilling in accordance with one embodiment.

FIG. 1 depicts a well drilling operation 10 involving drilling a plurality of densely packed wells using magnetic ranging while drilling. Specifically, the well drilling operation 10 includes an offshore platform 12 and numerous closely spaced wells 14 that extend from the platform 12, through a seabed 16, and into a formation 18. Specifically, the wells 14 extend vertically through a core drilling region 20 of the formation 18 in an essentially parallel orientation with respect to one another, and then, in a directional region 22 of the formation 18, the wells 14 branch out into deviated and horizontal trajectories to reach different areas of the formation 18. The core drilling region 20 may be defined by the area of the formation 18 in which the wells 14 are closely spaced, and the directional region 22 may be the area of the formation wherein the wells 14 are diverted. The core drilling region 20 may extend for several hundred meters into the formation 18 before wells begin diverting to other areas of the formation 18. Collisions between drilling assemblies and previously drilled wells in the tightly packed core drilling region 20 may be avoided with magnetic ranging while drilling. In accordance with one embodiment, coiled tubing, casing, or liners may be utilized.

As will be discussed in further detail below, magnetic ranging while drilling may be accomplished using a drill string that contains an insulated gap and magnetometers. A current may be generated across the insulated gap and then the current may pass through the formation 18 to nearby cased wells. The magnetometers in the drilling assembly may detect the induced magnetic field associated with currents on the casing or drill string left within a well. The magnetic field measurements may be inverted to gauge the location of the drill string with respect to the cased wells. Thus, collisions may be avoided by steering the drill string away from potential collisions.

Systems and procedures relating to magnetic ranging while drilling are more fully disclosed in PCT 2008/067976. Indeed, PCT 2008/067976 and the U.S. Provisional Application No. 60/951,145 from which it depends, which are each incorporated by reference herein in their entirety, describe how to position new wells between or among existing wells. Such systems and methods may be applicable to existing platforms that already have a number of cased wells. Features of the present disclosure are directed to a method including a sequence for drilling new wells, wherein each new well is positioned outside an area that encloses the previously drilled wells. One embodiment may facilitate densely packing a large number of well bores into a limited area, such as the space available on a new offshore platform.

Figure 2:
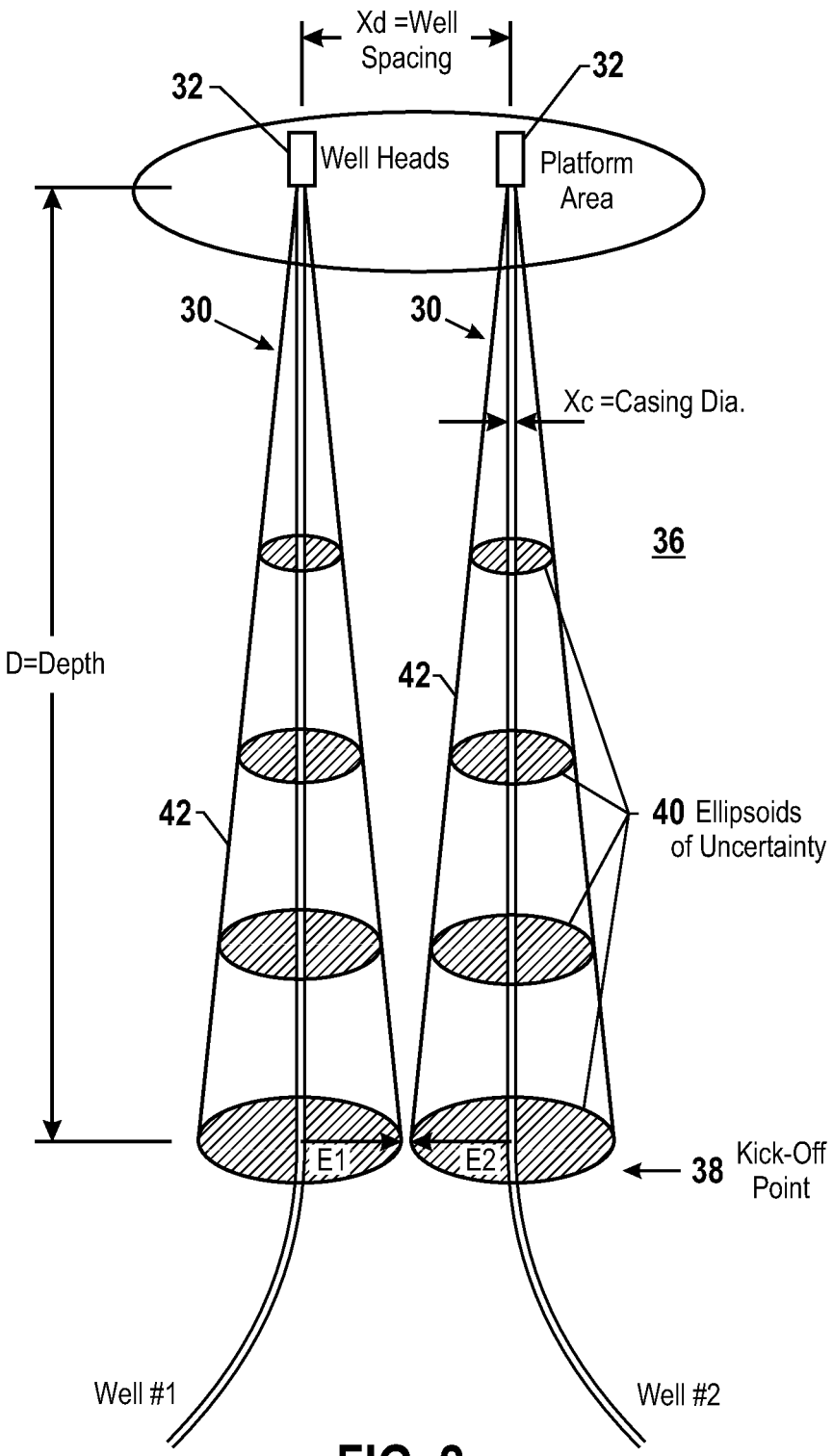
FIG. 2 illustrates a pair of wells having cones of uncertainty relating to measurement errors that may be addressed in accordance with one embodiment.

FIG. 2 illustrates a pair of wells 30 extending from well heads 32 disposed within a platform area 34, wherein the well heads 32 are spaced a certain distance, $X_d$, apart and the wells 30 have a casing diameter, $X_c$. As the wells 30 extend into a formation 36, the uncertainty in their location increases until they reach a kick-off point 38 and diverge. Indeed, with conventional practice, uncertainty in well position increases as the depth, D, of the well increases. For example, FIG. 2 represents this progressively increasing uncertainty with ellipsoids of uncertainty 40 that grow in size as the depth of each well 30 increases. The expanding ellipsoids 40 for a particular well combine to form elliptical cones of uncertainty 42 that cover certain areas of the formation 36 in which the wells 30 reside. This uncertainty may arise from the limited accuracy of the MWD and D&I measurements, and from the limited accuracy of any wireline surveys that might have been performed after the wells were cased. An MWD inclination measurement is typically accurate to only about 0.1° under the best circumstances, while an MWD directional measurement is typically accurate to about 1°. However, MWD survey points may be acquired only once over certain intervals (e.g., every 90 feet) in practice, so under-sampling may significantly increase the actual errors in the well position. In addition, if the directional measurement is based on the Earth's magnetic field, then it typically requires correction for variations in the Earth's magnetic field. In addition, the magnetic field can also be strongly perturbed by nearby casing. If the casings are very close to the well path, then the MWD directional measurement may not even be useful. In this case, a gyro may be used to provide the directional information. The gyro may be run with the MWD tool, or it may be run on a wireline with periodic descents inside the drill pipe to the bottom hole assembly (BHA). With regard to use of a gyro, the typical accuracy is on the order of 1° to 2°.

As set forth above, because space on an offshore production platform is at a premium (e.g., limited and expensive), well heads are generally packed as closely as possible. However, the distances between well heads, and therefore the number of wells, are typically limited primarily by elliptical cones of uncertainty, such as those illustrated in FIG. 2. For example, since a well casing of one of the wells 30 could be located anywhere inside the cones of uncertainty 42, the well heads 32 must be spaced a distance apart so that any two cones cannot overlap.

In situations with limited space, such as on an offshore platform, it may be desirable to drill wells in a generally parallel orientation relative to one another before the wells diverge into deviated well bores, as illustrated by the transition from the core drilling region 20 to the directional region 22 in FIG. 1. Indeed, as illustrated in FIG. 2, on a new platform where no wells had previously been drilled, the wells may be drilled as vertical as possible for a specified depth D, and then deviated. The slots (i.e. surface locations of the well heads) may be required to be separated a safe distance (e.g., $X_d$) such that the ellipsoids 40 for any two wells do not overlap at the depth D. Let E1 be the larger uncertainty in the x or y direction for a first well at depth D, and let E2 be the larger uncertainty in the x or y direction for a second well at depth D. The offset well safety factor (OSF) is defined as $$OSF = \frac{Xd - Xc}{\sqrt{(E_1)^2 + (E_2)^2}}, \tag{1}$$

where Xd is the well head separation and Xc is the casing diameter. The larger the offset well safety factor, the less likely that two wells will collide. Typically, it is desirable for OSF>1.5 to have the likelihood of a collision less than 5%.

As a specific example, it may be supposed that the wells will be vertical for a depth of 500 m (D=500 m), and that the casings will be 30 inches in diameter (Xc=0.76 m). Also, it may be assumed that the cones of uncertainty are determined only by the accuracy of the MWD inclination measurement ($\alpha=2\cdot10^{-3}$ radians, ~0.1°). The radii of the cones at depth may be E1=E2=$\alpha\cdot D$=0.9 m. The well head separation may be given by $$Xd=Xc+OSF\cdot\sqrt{(E1)^2+(E2)^2}=0.76\text{ m}+1.5\cdot\sqrt{2}\cdot(0.9\text{ m})=2.7\text{ m}.$$

It should be noted that the slot spacing may be determined by the accuracy of the MWD tool. If the MWD measurements are less accurate, or if the wells must go to greater depths, or if a greater safety margin is desired, it may be desirable to increase the distance between slots to avoid collision. This increase in distance between slots comes at an expense, since the area on the platform for the slots varies as $(Xd)^2$. Conversely, decreasing the slot spacing results in a reduction in area required by the wellheads 32. For example, decreasing the slot spacing by 30% (e.g. from 2.9 m to 1.9 m), may reduce the area required for the wellheads 32 by 50%. The platform area 34 used for a fixed number of wells can thus be significantly reduced with a corresponding cost savings, or the number of wells can be significantly increased per unit area.

Features of the present disclosure are directed to reducing the slot spacing using magnetic ranging while drilling. Further, in accordance with one embodiment, wells may be drilled in a certain sequence to efficiently exploit magnetic ranging. One embodiment may be limited by less restrictive constraints than the MWD system's measurement accuracy, and the inter-well spacing can be made as small as possible within the less restrictive constraints. An example of such a limiting constraint on an exemplary embodiment might be the strength of the formation when penetrated by a larger number of closely spaced wells.

Figure 3:
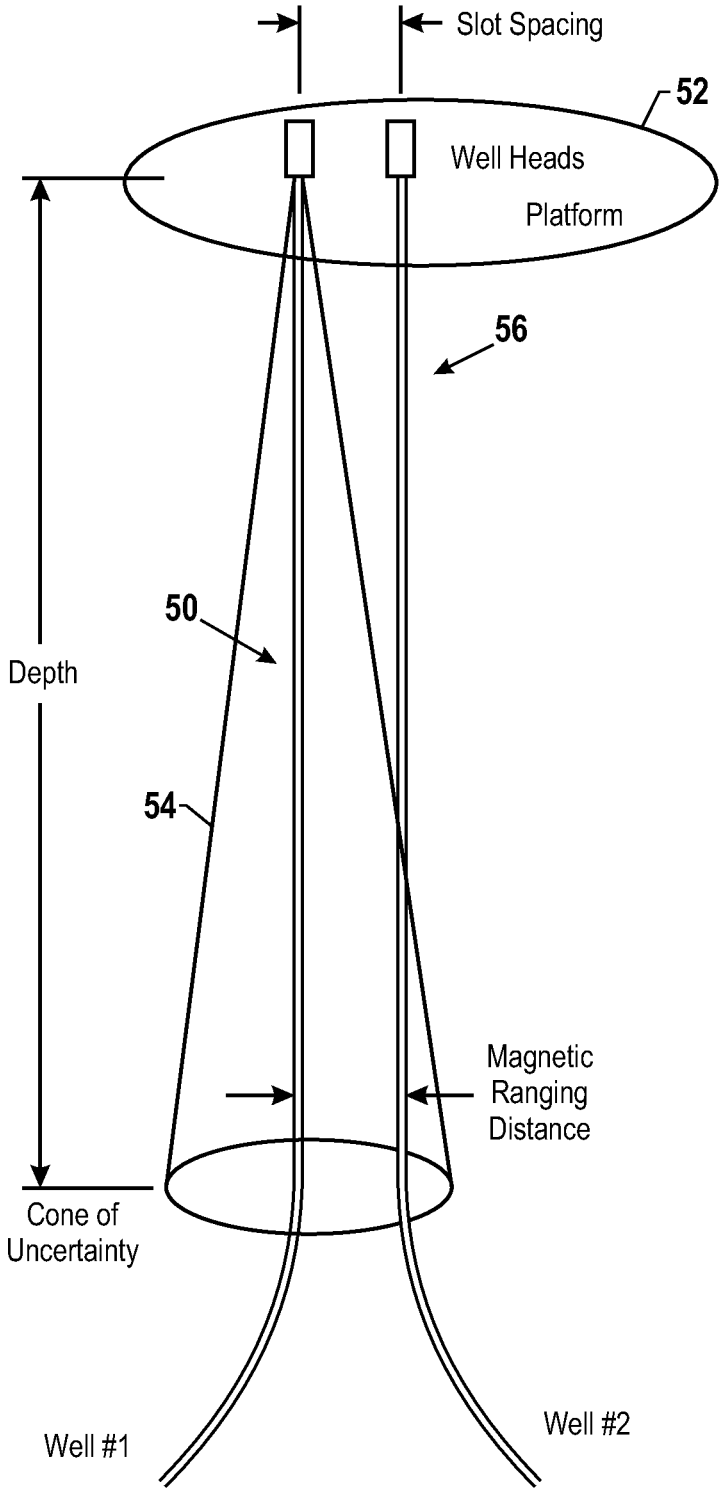
FIG. 3 illustrates a first well and a second well, wherein the second well has been drilled within the cone of uncertainty of the first well in accordance with one embodiment.

Presently disclosed processes may reduce related cones of uncertainty for all wells subsequent to the first well in the limited drilling area (e.g., the platform area available for wells). For example, as illustrated in FIG. 3, in accordance with one embodiment, a first well 50 drilled from a platform 52 may have a cone of uncertainty 54 that depends on the accuracy of the MWD and D&I measurements. However, a second well 56 may be drilled using magnetic ranging to maintain a parallel trajectory and a specified distance from the first well 50. Thus, the cone of uncertainty 54 is essentially irrelevant. Indeed, by monitoring the distance and direction from the second well 56 to the first well 50, the second well 56 can even be drilled inside the cone of uncertainty 54 of the first well 50, as illustrated in FIG. 3.

Figure 4:
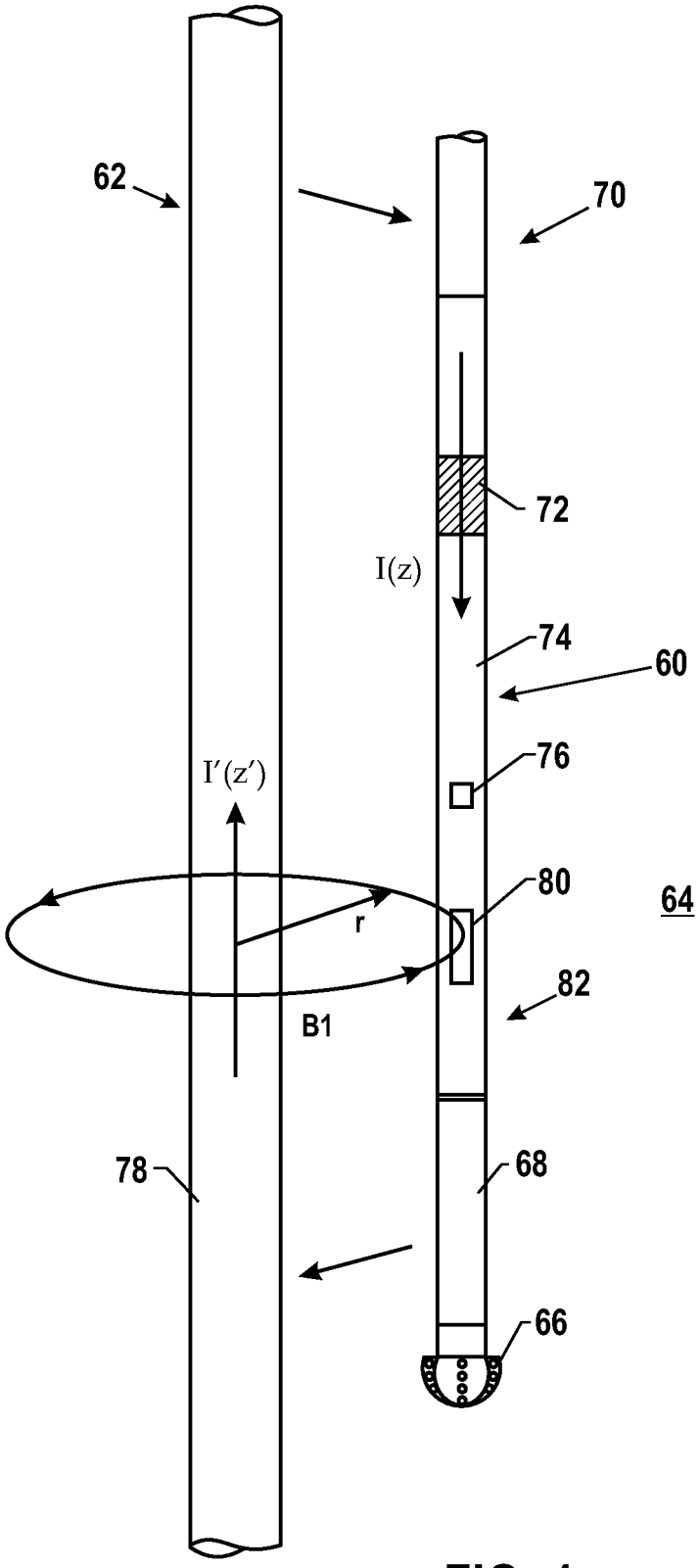
FIG. 4 illustrates a perspective view of a bottom hole assembly and a cased well in accordance with one embodiment.

FIG. 4 illustrates a BHA 60 and a cased well 62 disposed in a formation 64 and arranged in the basic configuration for magnetic ranging while drilling. In the illustrated embodiment, the BHA 60 includes a drill bit 66 and a directional drilling system 68, such as a rotary steerable system (RSS), that is positioned above the drill bit 66. Further, the BHA 60 includes a drill collar 70 with an insulated gap 72 that may be used to generate a low frequency electric current I(z) along the BHA 60. The drill bit 66 may be located at z=−L. An MWD tool 74 may provide a telemetry function to transmit data to the surface, and may also provide D&I measurements. An optional gyro 76 may be used to determine the direction in the event that there is significant magnetic interference from casing 78 of the cased well 62 or other nearby casing. A 3-axis magnetometer 80 may be located inside a non-magnetic drill collar 82, and may be configured to measure a magnetic field from an external source. The 3-axis magnetometer 80 may also be configured to be insensitive to a primary magnetic field related to the current I(z) on the BHA 60. Additional details regarding a system such as that illustrated in FIG. 4 may be found in U.S. application Ser. No. 11/833,032 (U.S. Pub. No. 2008/0041626), U.S. application Ser. No. 11/550,839 (U.S. Pub. No. 2007/0126426), U.S. application Ser. No. 11/781,704, and PCT 2008/067976 and U.S. Provisional Application No. 60/951,145 from which it depends, each of which is herein incorporated by reference in its entirety.

FIG. 4 illustrates a situation where the BHA 60 is generally parallel to the cased well 62, and located a distance r away. The current, I(z), on the BHA 60 flows into the formation 64 and some of it concentrates on the nearby casing 78 of the well 62. The current, I'(z), on the casing 78 generates an azimuthal magnetic field $\vec{B}$ given by the formula $$\vec{B}(r) = \frac{\mu_0 I'(z)}{2\pi r^2}\hat{z}\times\vec{r}, \tag{2}$$

where $\mu_0=4\pi\cdot10^{-7}$ Henry/m (permeability of free space), and where z is the direction along the axis of the cased well. The 3-axis magnetometer measures $\vec{B}$, from which the direction and distance to the casing is determined. Details regarding drilling a second well parallel to a first well are described in U.S. application Ser. No. 11/833,032 (U.S. Pub. No. 2008/0041626), U.S. application Ser. No. 11/550,839 (U.S. Pub. No. 2007/0126426), U.S. application Ser. No. 11/781,704, and PCT 2008/067976 and U.S. Provisional Application No. 60/951,145 from which it depends, each of which is herein incorporated by reference in its entirety.

In accordance with one embodiment, a second well (e.g., the well being drilled with the BHA 60) may be placed very close to a first well (e.g., the cased well 62) without risking a collision by using magnetic ranging while drilling techniques. A specified separation between two wells may be maintained regardless of the depth at which the wells are drilled. Thus, in accordance with one embodiment, the ellipsoid of uncertainty for a particular well does not depend entirely on the MWD and D&I measurements, but, rather, depends on the accuracy of the magnetic ranging measurement, which is insensitive to drilled depth. In one embodiment, the distance between the first well and the second well may depend on the accuracy of the magnetic field amplitude measurement and on the accuracy of the estimate for the current on the casing, i.e. the distance accuracy depends on $B=|\vec{B}|$ and I'(z). A specified direction of the second well with respect to the first well may also be maintained regardless of depth. The relative direction from the first well to the second well in the x-y plane is related to the measurement of the two magnetic field components, $B_x$ and $B_y$, where $\vec{B}=B_x\hat{x}+B_y\hat{y}$.

Figure 5:
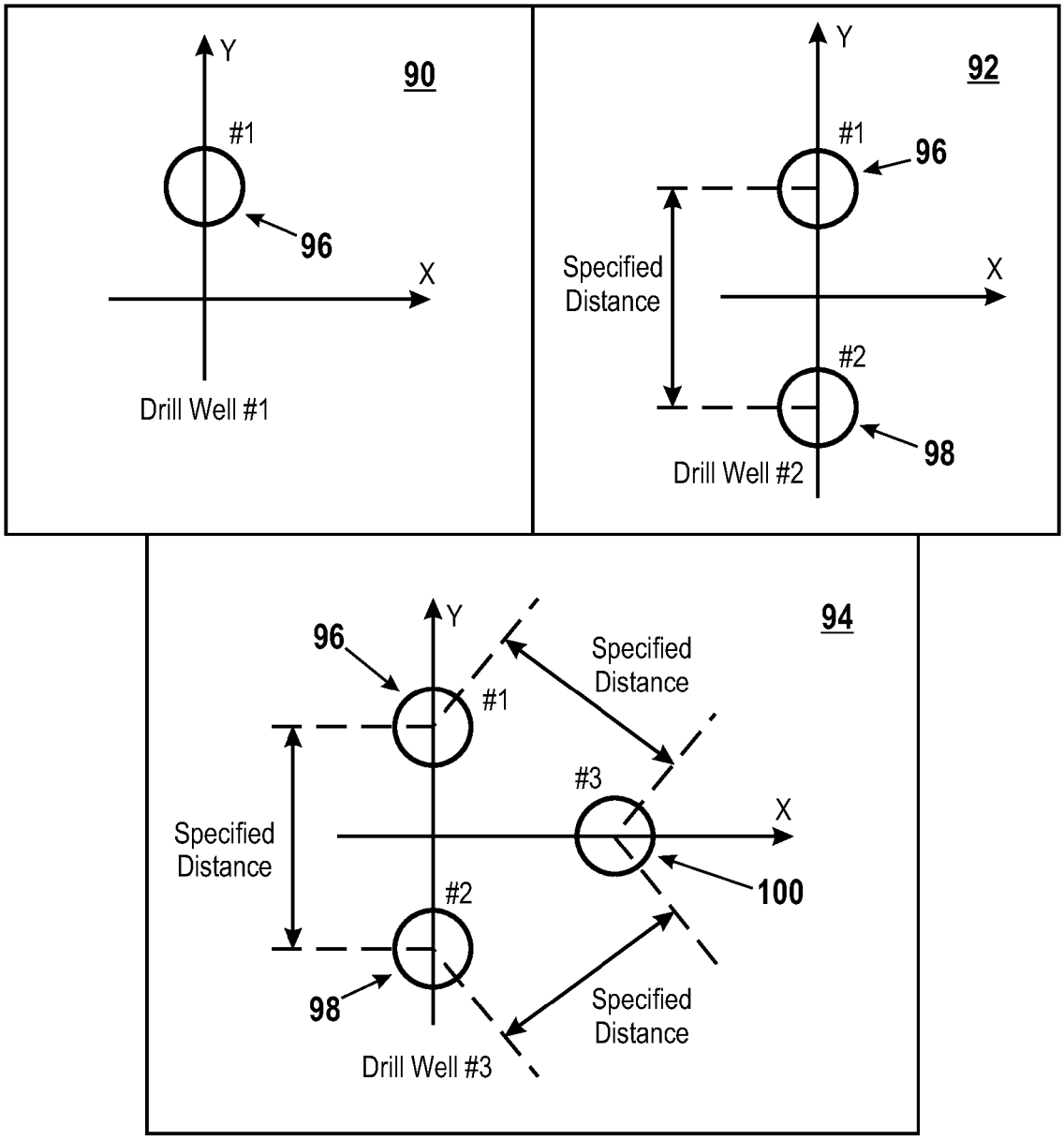
FIG. 5 illustrates a sequence for drilling a triangular well pattern in accordance with one embodiment.
Figure 6:
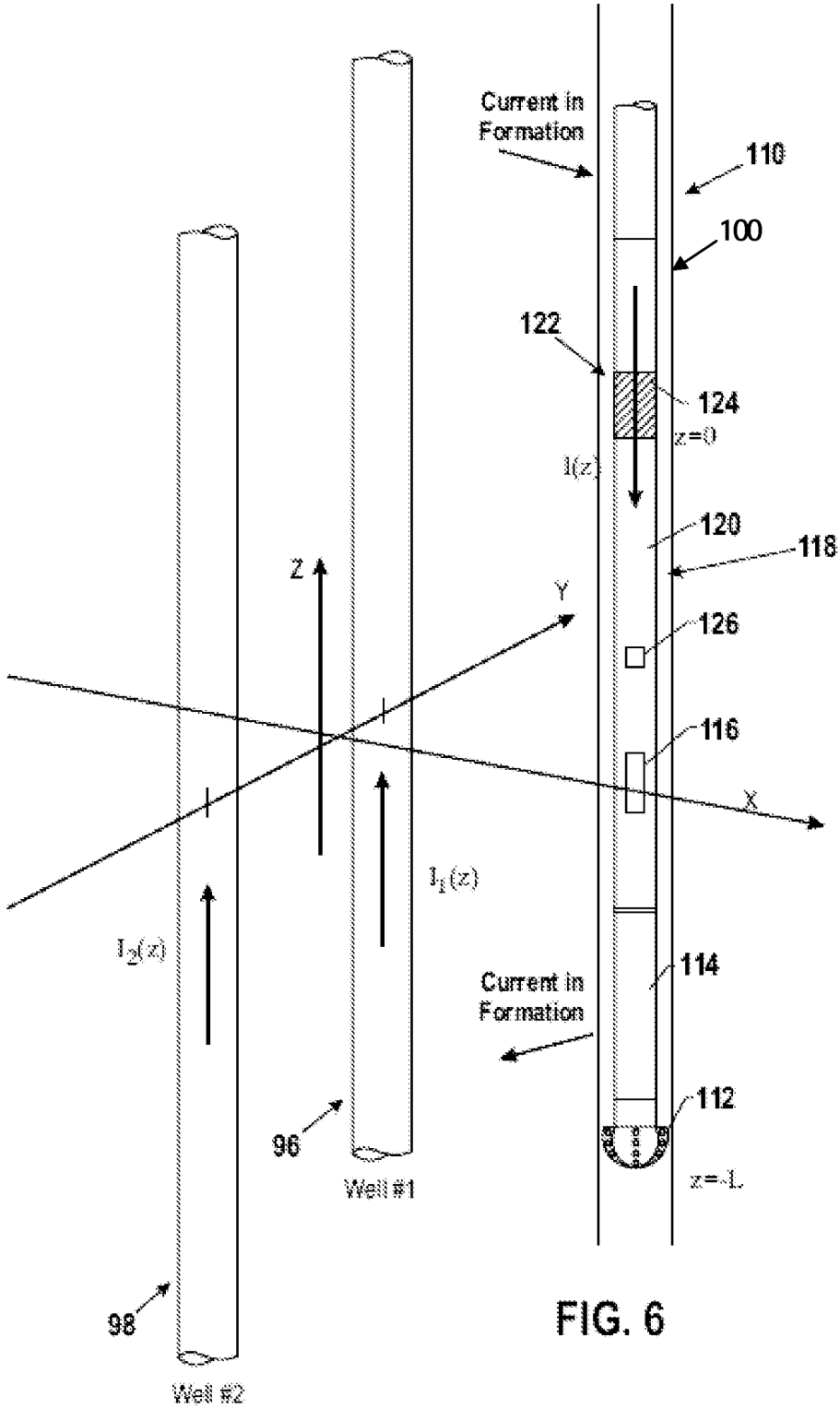
FIG. 6 illustrates a perspective view of a pair of cased wells and a third well being drilled by a bottom hole assembly in accordance with one embodiment.

FIGS. 5 and 6 represent positioning of wells in a specific relationship relative to one another in a formation. Specifically, FIG. 5 is an overhead view of a plurality of wells that illustrates a sequence for drilling wells in a triangular well pattern. The sequence, which includes drilling three wells in positions relative to one another, is represented by blocks 90, 92, and 94, wherein each block represents the addition of a new well. The first block 90 represents drilling a first well 96 with MWD measurements; the second block 92 represents drilling a second well 98 substantially parallel to the first well 96 using magnetic ranging; and the third block 94 represents drilling a third well 100 substantially parallel to the first and second wells 96, 98 using magnetic ranging while drilling.

FIG. 6 is a cross-sectional view of the wells in FIG. 5, wherein a BHA 110 for magnetic ranging is being used to drill the third well 100 relative to the first and second wells 96, 98. As illustrated in FIG. 6, the current generated on the BHA 110, (I(z)), flows into the formation and concentrates on the casings of the first well 96 and the second well 98 as $I_1(z)$ and $I_2(z)$, respectively. Values associated with these current concentrations may be utilized for positioning the third well 100, as will be discussed further below.

As illustrated in FIGS. 5 and 6, after the second well 98 has been drilled parallel to, and a specified distance from the first well 96, the third well 100 may be drilled with respect to the first well 96 and the second well 98. In the illustrated embodiment, the third well 100 may be drilled the same specified distance from both the first well 96 and the second well 98. This results in a "dense-packing" arrangement of cylinders, with the casing in the center of each cylinder. For a specified distance between casings, this may be approximately 15% more efficient than a rectangular arrangement of wells. However, a substantial advantage in accordance with one embodiment is the use of magnetic ranging to control the inter-well spacing, which can be utilized to provide a densely packed rectangular well arrangement as well.

Like the BHA 60 discussed above with respect to FIG. 4, the BHA 110 illustrated in FIG. 6 may contain a drill bit 112, a directional drilling system 114, such as an RSS, a 3-axis magnetometer 116 located inside a drill collar 118, an MWD telemetry system 120 capable of sending data to the surface, and a drill collar 122 with an insulated gap 124 which can produce a current on the BHA 110. In addition, external magnetometers may also be used as described in U.S. application Ser. No. 11/781,704, which is herein incorporated by reference in its entirety. In the illustrated embodiment, the z-axis is taken to be the axis of the first well 96. It should be noted that the first well 96 could be vertical or deviated, and subsequent wells may be drilled essentially parallel to it.

With regard to the embodiment illustrated in FIG. 6, the insulated gap 124 in the BHA 110 may generate a low frequency (e.g. typically 0.1 Hz to 100 Hz) electric current, I(z). It may be assumed that the currents and magnetic fields are oscillatory and therefore the magnetic fields distinguishable from the Earth's dc magnetic field. The current on the BHA 110 is given by $I(z,t)=I(z)\cdot\cos(2\pi ft+\phi)$ where t is time, f is frequency, and $\phi$ is a phase. A square wave or triangular excitation may also be used. Hereafter, the time and frequency dependence is suppressed in the formulas, but should be understood.

The current I(z) decreases with distance (z) from the insulated gap 124 as it flows into the formation. For example, between the insulated gap 124 and the drill bit 112, the current decreases in an approximately linear manner as $I(z)\approx I(0)(1+z/L)$ where L is the distance from the insulated gap 124 to the tip of the drill bit 112, and where $z<0$ below the insulated gap 124. Current may concentrate in the casings of the first well 96 and the second well 98 and return along these wells as $I_1(z)$ and $I_2(z)$, respectively. The current on the first well 96 may induce a magnetic field $\vec{B}_1$, and the current on the second well 98 may induce a magnetic field $\vec{B}_2$. Both magnetic fields lie in the x-y plane, i.e. there is no $B_z$ component.

It may be assumed that the length of the BHA 110 below the insulated gap 124, (L), is much larger than the inter-well spacing for the purpose of reducing complication in the mathematical analysis. However, the present disclosure does not depend on this assumption. Hereafter, for purposes of simplification, the explicit z dependence may be dropped from many equations. It should be understood that the quantities are evaluated at the same depth as the magnetometer.

Figure 7:
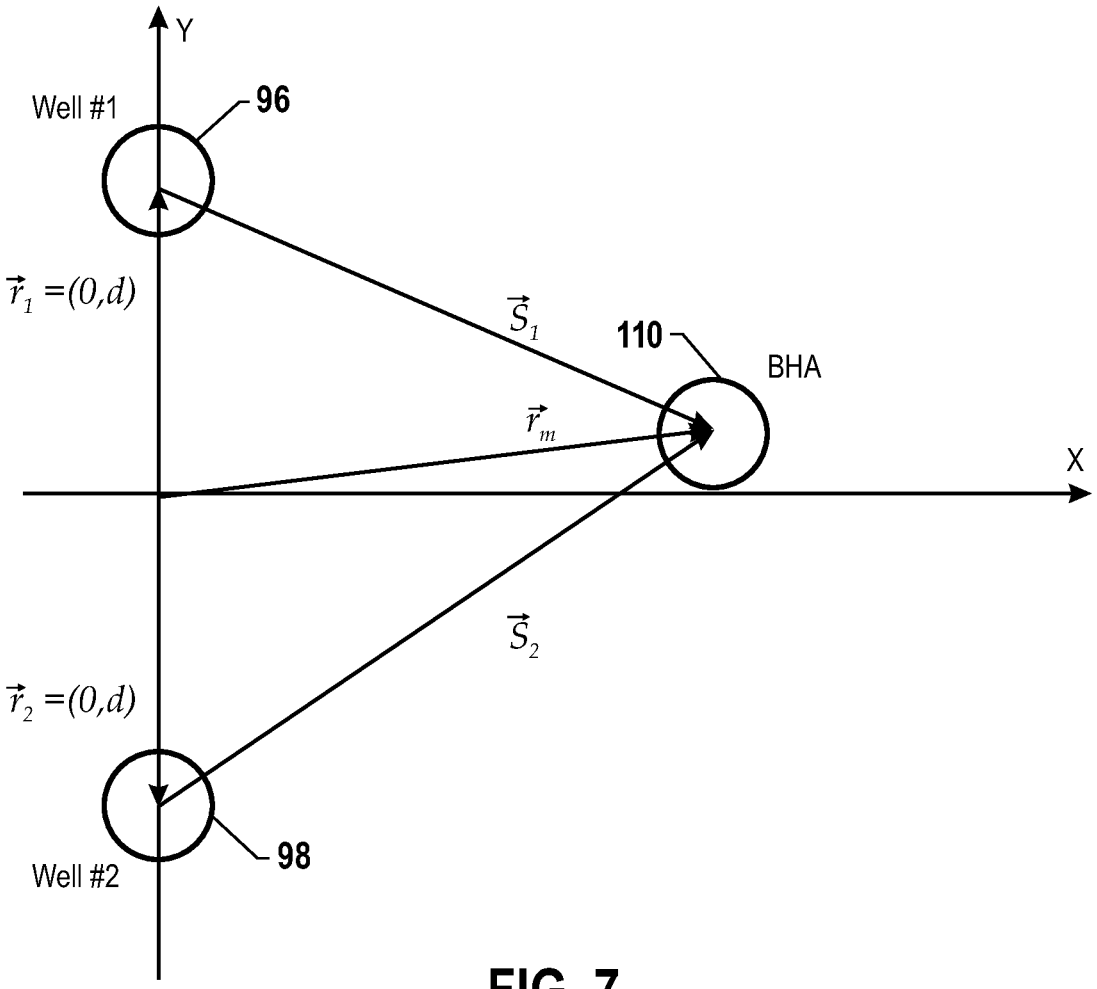
FIG. 7 is a geometric representation of three wells arranged in a triangular well pattern in accordance with one embodiment.

FIG. 7 illustrates the geometry of the arrangement of the first well 96, the second well 98, and the BHA 110 of FIG. 6. Referring to FIG. 7, let the magnetometer in the center of the BHA 110 be located at $\vec{r}_m=(x_m,y_m)$; let the first well 96 be located at $\vec{r}_1=(0,d)$, let the second well 98 be located at $\vec{r}_2=(0,-d)$. The vector that points from the first well 96 to the BHA 110 is $\vec{S}_1=\vec{r}_m-\vec{r}_1=(x_m,y_m-d)$. The vector that points from the second well 98 to the BHA 110 is $\vec{S}_2=\vec{r}_m-\vec{r}_2=(x_m,y_m+d)$. Hence, the distances from the BHA 110 to the two cased wells 96 and 98 are $S_1=\sqrt{x_m^2+(y_m-d)^2}$ and $S_2=\sqrt{x_m^2+(y_m+d)^2}$, respectively. Accordingly, ideally, the third well 100 will be positioned at $\vec{r}_m=(\sqrt{3}\,d,0)$, so that the wells are equally separated by the distance $S_1=S_2=2d$ .

The induced magnetic field measured at the 3-axis magnetometer 116 in the BHA 110 due to the current Ii on the ith casing is given by $$\vec{B}i=\frac{\mu_0 Ii(z)}{2\pi Si^2}\hat{z}\times\vec{S}i.$$

The total induced magnetic field at the 3-axis magnetometer 116 is the sum of the induced magnetic fields from the two casings, $$\begin{aligned}\vec{B}(x_m,y_m)&=\sum_{i=1}^{n}\vec{B}i(x_m,y_m)\\&=\sum_{i=1}^{n}\frac{\mu_0 Ii(z_m)}{2\pi Si^2}\hat{z}\times\vec{S}i\\&=\sum_{i=1}^{n}\frac{\mu_0 Ii(z_m)}{2\pi Si^2}\hat{z}\times(\vec{r}_m-\vec{r}i),\end{aligned}\tag{3}$$

$$n=2,$$

$$\begin{aligned}\vec{B}i(x_m,y_m)&=\frac{\mu_0 Ii(z_m)}{2\pi Si^2}[(y_i-y_m)\hat{x}+(x_m-x_i)\hat{y}]\\&=\frac{\mu_0 Ii(z_m)}{2\pi}\frac{(y_i-y_m)\hat{x}+(x_m-x_i)\hat{y}}{(x_m-x_i)^2+(y_m-y_i)^2}.\end{aligned}\tag{4}$$

It should be noted that there is no Bz component since it has been assumed that the BHA 110 and casings all are in the z-direction. Further, it should be noted that these equations can be applied to more than two wells if n>2.

In accordance with a disclosed embodiment, the sum of the currents on all of the casings must not exceed the current generated at the insulated gap 124 on the BHA 110. Indeed, in accordance with one embodiment, at the depth of the magnetometer 116, these currents must be equal or less than the current on the BHA 110, $$I\geq\sum_{i=1}^{n}Ii.$$

The current on a casing depends on its position relative to the BHA 110, on the resistivities of the formation and the cement surrounding the casing, and on the presence of nearby casings. The currents and resulting induced magnetic field can be obtained from a full 3D numerical model, but a simpler approach may be sufficient for purposes of explaining an exemplary embodiment. With the assumption $L>>S_i$, the current distributions on adjacent casings can be approximated with a simple formula describing the conductance between two long, parallel cylinders. If the parallel conductors have the same diameter $\delta$, and if they are separated by the distance $S_i$, then the conductance per unit length between two cylinders may be given by $$Gi=\frac{\pi\sigma}{\cosh^{-1}(S_i/\delta)}.\tag{5}$$

This expression applies for a homogeneous formation with conductivity $\sigma$. If there are formation layers, a significant amount of cement, or the like, then a more exact solution may be utilized. In view of equation (5), the current on the ith casing is proportional to Gi, i.e.

$$Ii(z) = \frac{Gi}{\sum Gi} I(z), \tag{6}$$

where the sum is over the adjacent casings. A fraction of the BHA current will return though the borehole and shallow formation, but this small effect is also neglected here. These effects can be included in a more rigorous 3D numerical analysis.

It should be noted that $\vec{B}(x_m,y_m)$ is not a vector magnetic field in the normal sense. It is the magnetic field at the location of the magnetometer inside the drill collar 118, when the magnetometer 116 is located at $(x_m,y_m)$. The current flowing on the BHA 110 itself does not produce a magnetic field inside the BHA 110, but it does produce a strong magnetic field outside the BHA 110. This external field is not included in the expression for $\vec{B}(x_m,y_m)$, but it is included in any expression for the magnetic field outside the BHA 110. Also, the currents on the casings may change if the BHA 110 is in a different location, and this effect is included in the expression for $\vec{B}(x_m,y_m)$.

A specific example of $\vec{B}(x_m,y_m)$ is as follows. It may be assumed that the two cased wells in FIG. 7, the first well 96 and the second well 98, are respectively located at $(x_1,y_1)=(0,0.5)$, $(x_2,y_2)=(0,-0.5)$, while the BHA 110, which is in the process of drilling the third well 100, is located at $(x_m,y_m)$. The ideal position for the third well 100 would be $(x_m,y_m)=(0.87,0)$ which corresponds to an inter-well spacing with $S_1=S_2=1$. Let the sum of the currents on the two cased wells at the location of the magnetometer be 7.0 amps. From the previous expression for the magnetic field, one may calculate Bx(0.87,0)=0 and By(0.87,0)=1.21 μTesla.

Figure 8:
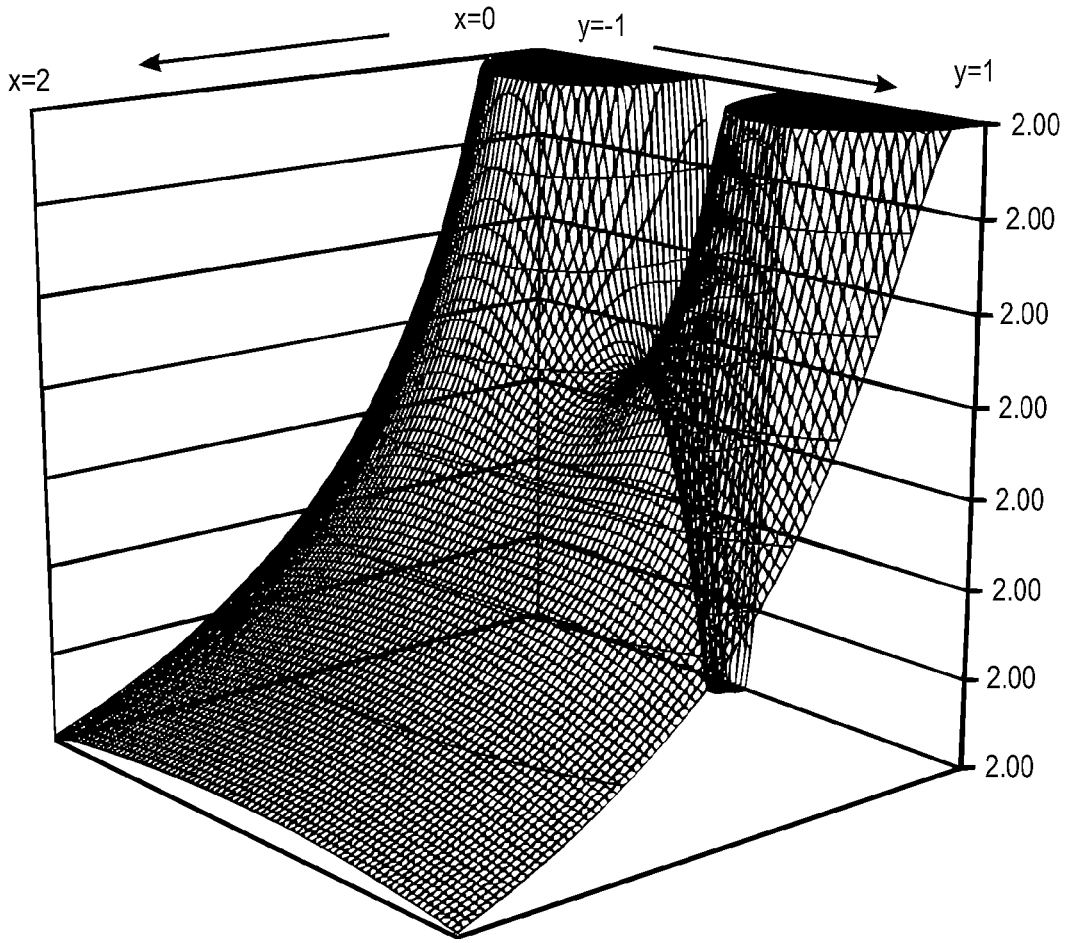
FIGS. 8-10 illustrate 3D plots of magnetic field strength in accordance with one embodiment.

FIG. 8 illustrates a 3D plot of the total magnetic field amplitude, $Bt=\sqrt{(Bx)^2+(By)^2}$, for the range x∈[0,2] and y∈[−1,1]. The cased wells are located at $\vec{r}_1=(0,0.5)$ for the first well 96 and at $\vec{r}_2=(0,-0.5)$ for the second well 98. The effects of the first well 96 and the second well 98 on the magnetic field are clearly recognizable in the 3D plot of FIG. 8 as the measured magnetic field increases rapidly if the BHA 110 drifts toward a cased well. Of course, this effect can be used to avoid a collision, but the purpose here is to place the third well 100 a precise distance from the two existing wells 96, 98. In accordance with an exemplary embodiment, the desired position for the third well 100 may be the line between the two lowest bands, where Bt=1.21 μTesla.

The ability to resolve the total magnetic field $\vec{B}_t$ into Bx and By components provides the ability to locate the BHA 110 in the x-y plane. It should be noted that resolving the Bx-By components of the induced magnetic field may be achieved by utilizing an independent measurement of the BHA orientation, i.e. x-y, or North and East. Normally, this may be provided by a measurement of the Earth's magnetic field. This magnetometer measurement can be acquired with the BHA current switched off. However, nearby steel casings may perturb the Earth's magnetic field and thus degrade the directional measurement, which may reduce the accuracy with which one can resolve the x-y directions.

Alternatively, an MWD gyro 126 can be used to determine the direction, or a wireline gyro can be run in the drill string periodically to determine the x-y directions. Either could be used to calibrate the effect of the casings on the Earth's magnetic field, or used directly to determine orientation with respect to North. If the wells are slightly inclined, then gravity tool face can be used to determine the x-y directions. Gravity tool face may be defined as the BHA orientation with respect to down, as determined by an MWD inclinometer. It may be assumed in the subsequent analysis that the x-y directions have been determined by one means or another.

Figure 9:
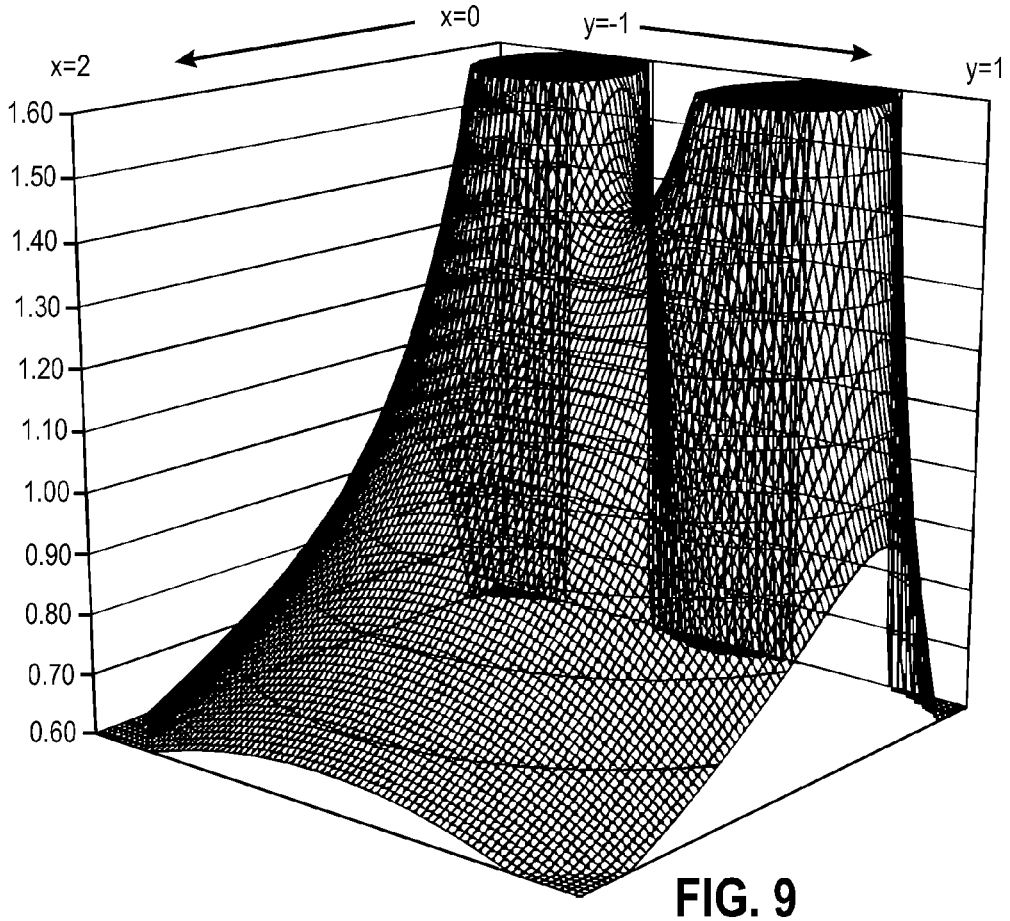

FIG. 9 is a 3D plot of By over the range x∈[0,2] and y∈[−1,1]. The magnetic field component By falls off rapidly in the x-direction, so that the BHA's position in the x-direction can be determined from the magnetometer measurement. The optimum position for the BHA 110 is at $(x_m,y_m)=(0.87,0)$, where By=1.21 μTesla. There is a steep gradient of By versus x which will allow the well to be positioned accurately with respect to the x coordinate. Measuring By with an accuracy of ±10 nTesla corresponds to an accuracy of ±5 cm in the x-direction. However, there is little variation of By versus y, so the BHA position in the y direction cannot be accurately inferred from By.

Figure 10:
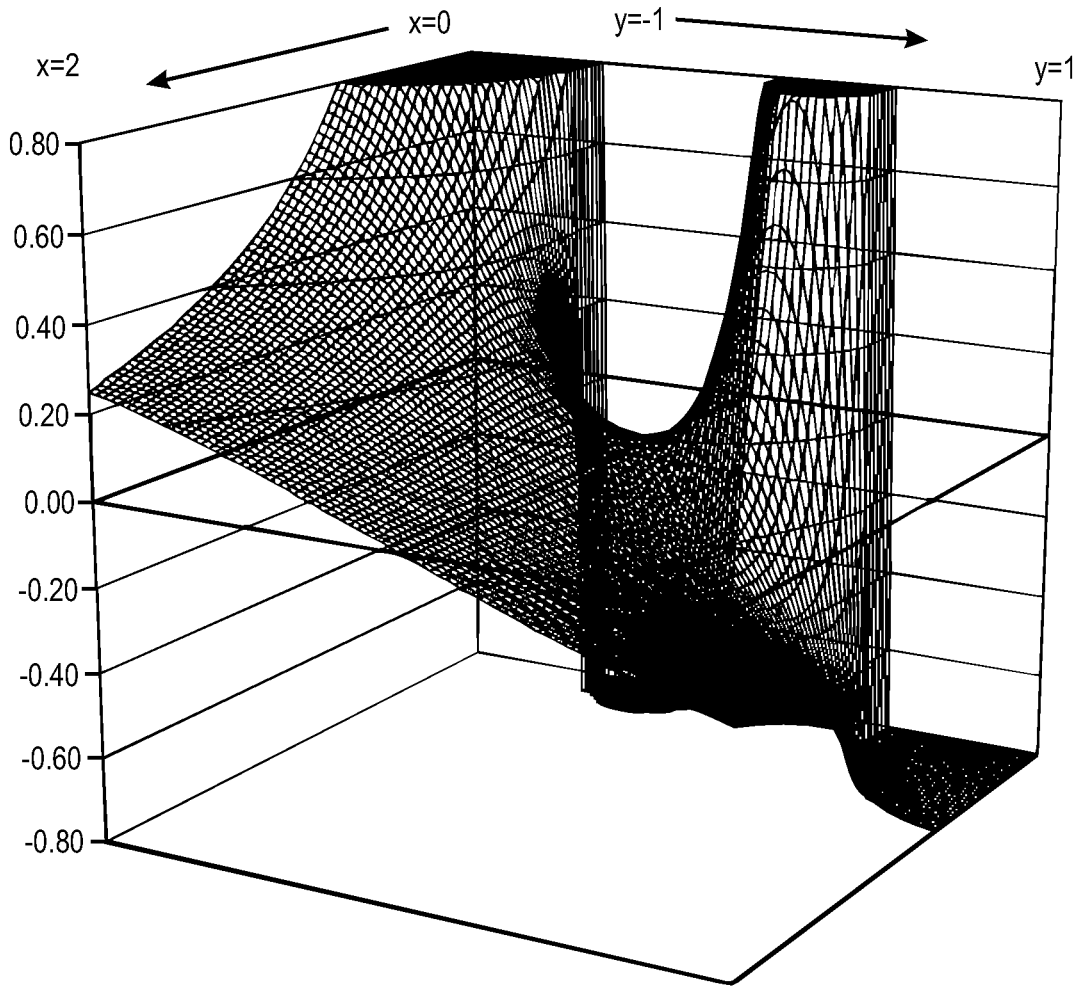

FIG. 10 is a 3D view of Bx in the region x∈[0,2] and y∈[−1,1]. The magnetic field component Bx changes with the y position, so that the magnetometer reading can be used to determine the BHA position in the y-direction. There is a strong variation of Bx with respect to y. If Bx>0, then $y_m<0$ and the BHA 110 should be steered in the +y direction. Similarly, if Bx<0, then $y_m>0$ and the BHA 110 should be steered in the −y direction. Measuring Bx with an accuracy of ±10 nTesla corresponds to an accuracy of ±8 cm in the y-direction.

One embodiment may be applicable in various situations. For example, one embodiment may be employed on offshore platforms with combined drilling and production operations. Such platforms are often large and permanently mounted to the seafloor. Thus, with this type of platform, space may be strictly limited and very valuable because the platform cannot be moved. The number of wells that can be drilled from such a platform may be limited by the area of the platform that contacts the seafloor, and by the inter-well spacing. The efficiency of this type of platform may benefit from the use of techniques and systems in accordance with one embodiment that employs magnetic ranging techniques and/or specific drilling sequences and patterns to place wells close to each other.

Packing cylinders in a hexangular pattern (also referred to as "dense-packing") may provide the most efficient use of a limited area. Compared to a rectangular packing, the number of cylinders per unit area is generally 15% higher for a hexangular arrangement. Hence, arranging well heads in a hexangular pattern may be desirable for a platform with a limited area for well heads.

Figure 11:
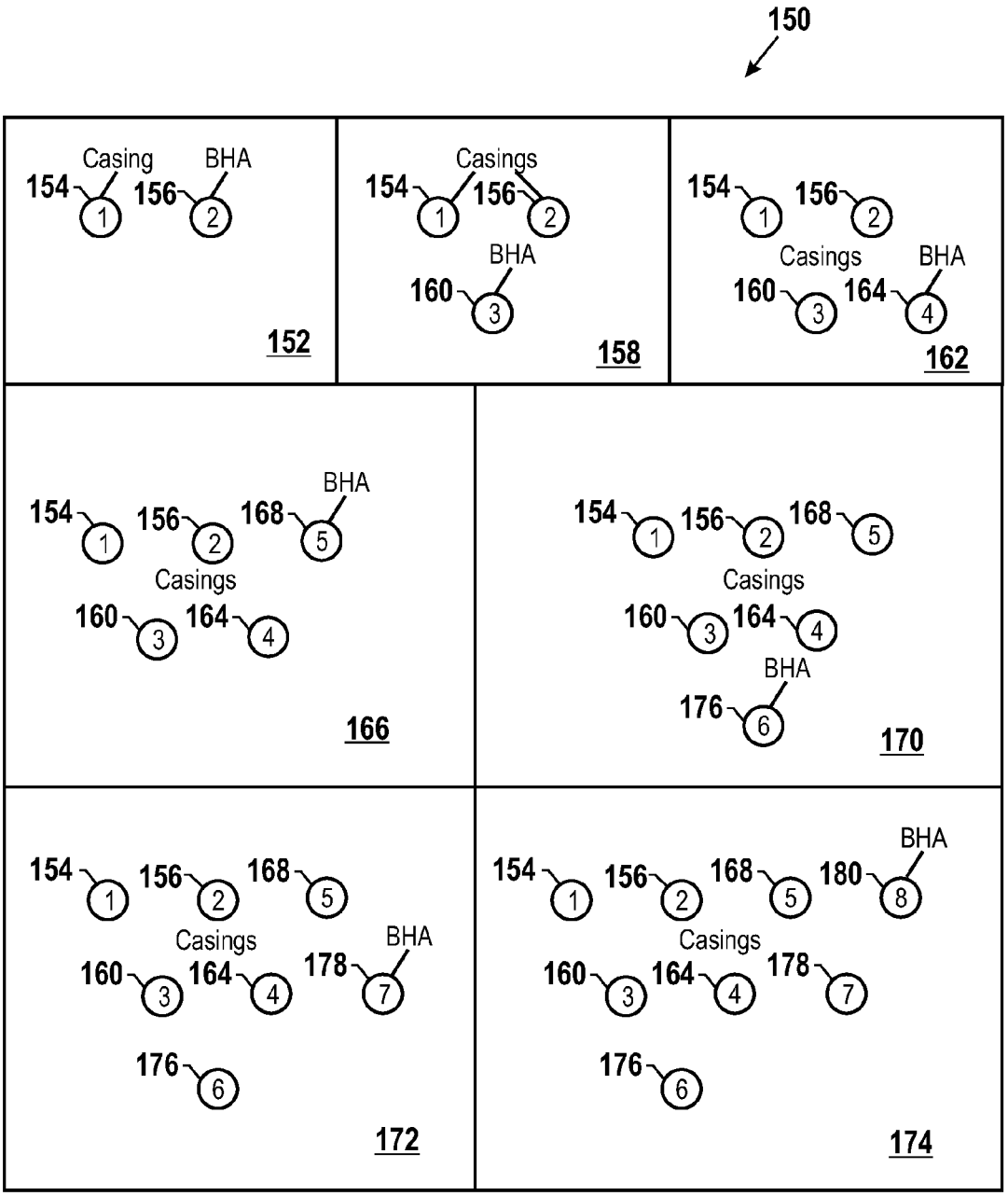
FIG. 11 illustrates a sequence of well construction in accordance with one embodiment.

One sequence of well construction to create a triangular or dense-packing geometry in accordance with one embodiment is illustrated in FIG. 11. Specifically, FIG. 11 illustrates a sequence 150 of well construction using magnetic ranging to create a dense-packing geometry (triangular arrangement) in a formation. The sequence 150 is represented by seven boxes that each represents a step or stage of the sequence 150. Indeed, each box describes a step or stage of the sequence 150 that includes drilling of a new well. In each box, the new well being drilled is indicated as including a BHA because the BHA is disposed in the new well and/or is being utilized in the process of drilling the well. In summary, the sequence 150 includes: (1) drilling an initial well with MWD and D&I, (2) drilling subsequent wells using magnetic ranging to control the distance to the previously drilled wells, and (3) drilling in a sequence wherein new wells are placed in specified arrangement next to existing wells.

As a first step 152, a first well 154 may drilled with MWD and D&I measurements, and a second well 156 may be drilled using MWD, D&I and magnetic ranging to maintain a specified distance and direction from the first well 154. In a second step 158, a third well 160 may be positioned at the apex of an equilateral triangle formed by the first, second, and third wells 154, 156, 160 using magnetic ranging, as described previously and as depicted in FIGS. 5-10. In a third step 162, a fourth well 164 may be positioned adjacent to the second well 156 and the third well 160 following the same general process that was used for drilling the third well 160. The effect of the first well 154 on the magnetic field measurements will be small because it is screened from the BHA by the second well 156 and the third well 160. Hence, the fields will be similar to those plotted in FIGS. 7-10. In any event, the first well 154 can be explicitly included in the model for the magnetic field if needed. In a fourth step 166, a fifth well 168 may be placed equidistance from the second well 156 and the fourth well 164. As illustrated in steps 170, 172, and 174, this well placement process may be continued to add wells at the perimeter, building new wells adjacent to existing wells. For example, a sixth well 176 may be added using a process similar to that utilized to drill the third well 160. A seventh well 178 may be positioned primarily with respect to wells 164 and 168, and a small affect from more distant well 176 may be taken into account. An eighth well 180 may be placed with wells 168 and 178, and so forth.

Another application of an exemplary embodiment may relate to offshore jack-up rigs with fixed production platforms. Jack-up rigs are the most common type of offshore drilling rig. A jack-up rig is used to drill a well or to work-over a well. A separate and permanent platform is used for production, while the jack-up is moved off location to drill other wells. This is much less expensive than building a permanent drilling and production platform.

The area of this type of production platform for slots is limited by the jack-up rig. The derrick of a jack-up rig is typically mounted on a moveable platform that extends beyond the rig floor and over the production platform. Because the range of motion for the derrick is limited, the area for slots is limited. Furthermore, the derrick moves on x-y rails so the most efficient shape for the slot array is also rectangular.

Moving the entire jack-up rig to a new position is expensive, and it can be dangerous to move it a short distance to drill more wells in the same production platform. The repositioned jack-up legs might punch-through seabed that was stressed by the previous legs' positions, and the rig can be damaged or even collapse. Hence, a method to increase the slot density for the existing jack-up fleet could substantially reduce development costs.

Figure 12:
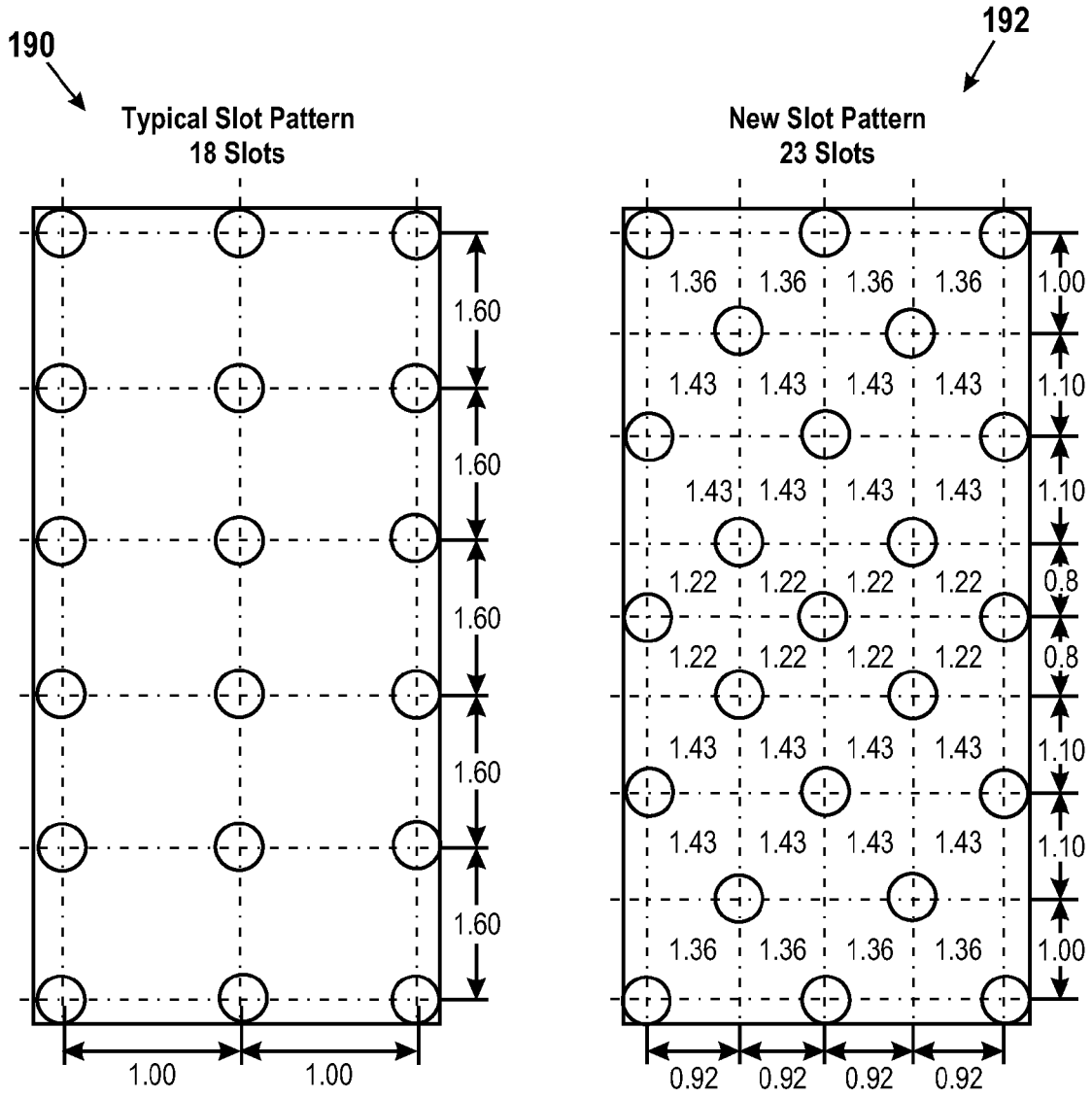
FIG. 12 illustrates a typical slot pattern compared to a slot pattern in accordance with one embodiment.

FIG. 12 illustrates a typical slot pattern 190 for an offshore production platform on the left side of the figure, and a slot pattern 192 in accordance with one embodiment on the right side of the figure. As an example, dimensions between wells are labeled in FIG. 12, and it should be noted that all dimensions are in meters. The typical slot pattern 190 includes 18 slots, in 3 columns of 6 wells each (a 3×6 rectangular array) with the slots placed on a 1.60 m by 1.85 m grid. The closest distance between any two wells is 1.60 m to prevent collisions between wells. In contrast, the slot pattern 192 in accordance with one embodiment includes 23 slots within the same surface area as that of the typical slot pattern 190, where the closest spacing between two slots has been reduced to 1.22 m. Increasing the number of slots from 18 to 23 slots represents a 28% increase in the number of wells.

Figure 13:
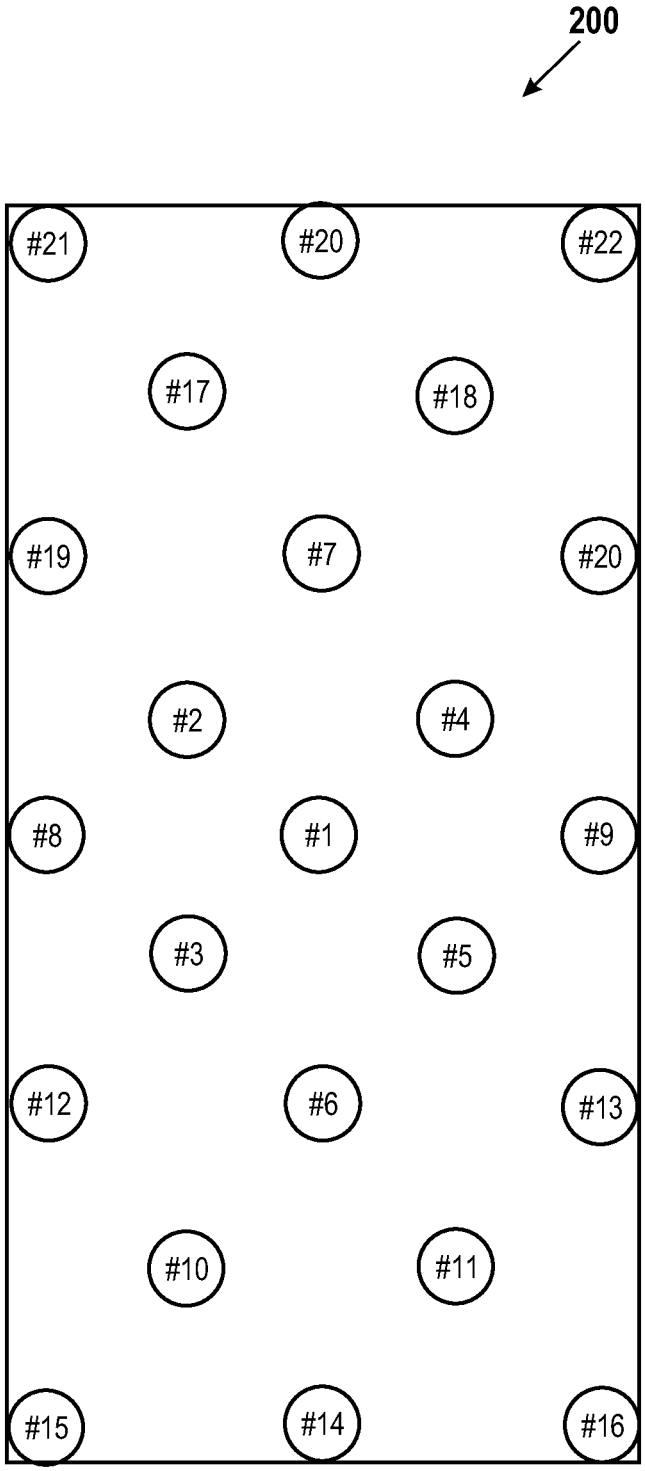
FIG. 13 illustrates a sequence of wells drilled in a designated area in accordance with one embodiment.

Another sequence for drilling wells in accordance with an exemplary embodiment is illustrated in FIG. 13. Specifically, FIG. 13 includes a pattern of wells 200 representing the result of a drilling sequence, wherein each well is labeled with a number representing the order in which the well was drilled in the sequence. For example, the first well is indicated by "#1", the second well is indicated by "#2", the third well is indicated by "#3," and so forth. The first well may be drilled in the center of the platform using conventional MWD and D&I measurements. The second well may be drilled using MWD, D&I and magnetic ranging to maintain a constant distance from the first well. Then the third well may be drilled relative to the first and second wells.

Figure 14:
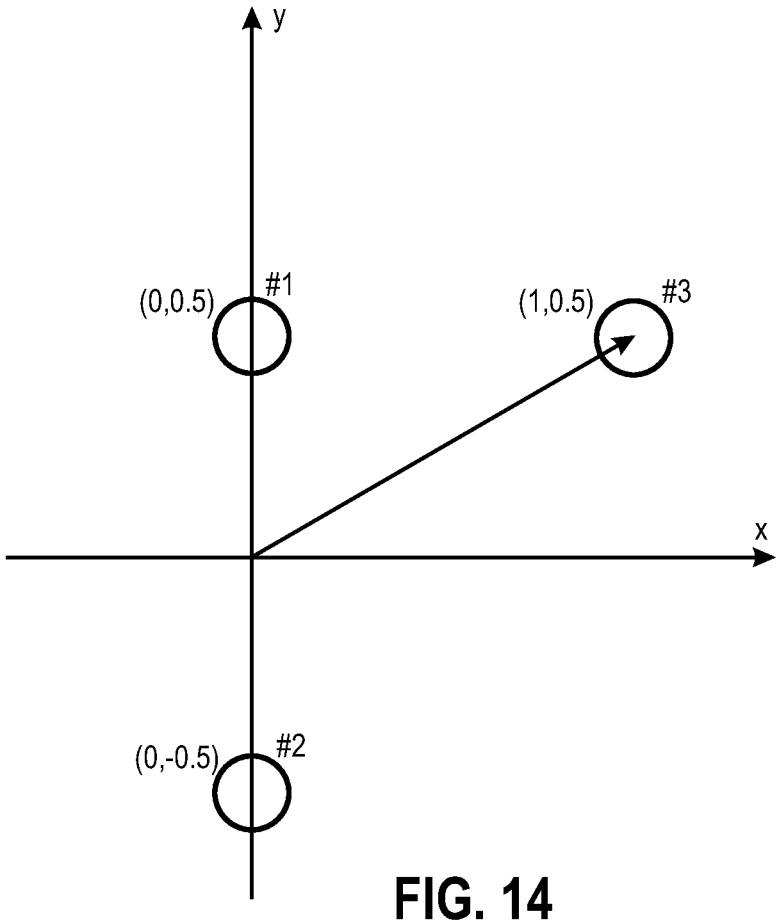
FIG. 14 is a geometric representation of three wells arranged in a pattern in accordance with one embodiment.

FIG. 14 represents the geometry associated with placement of the third well with respect to the first and second wells. It should be noted that the distances illustrated in FIG. 14 are slightly different than those shown in FIG. 12. In the interest of simplicity, in FIG. 14 and in subsequent figures, the wells will be placed on a grid with unit spacing. Also, the x-y coordinates in these figures are rotated for clarity. As illustrated in FIG. 14, in contrast to the triangular pattern, the third well may not be spaced the same distance from the first and second wells.

Referring to FIG. 14, it may be desirable to place the third well in a rectangular pattern at (x,y)=(1,0.5) m, with the first well located at (x,y)=(0,0.5) m, and the second well located at (x,y)=(0,−0.5) m. As in the previous example, the sum of the first two cased wells' currents is 7.0 amps at the depth of the magnetometer. The optimum position for the BHA may be (x,y)=(1,0.5). At (x,y)=(1,0.5) m, the model predicts $B_x(1, 0.5)=-0.326$ μTesla and $B_y(1,0.5)=1.074$ μTesla.

Figure 15:
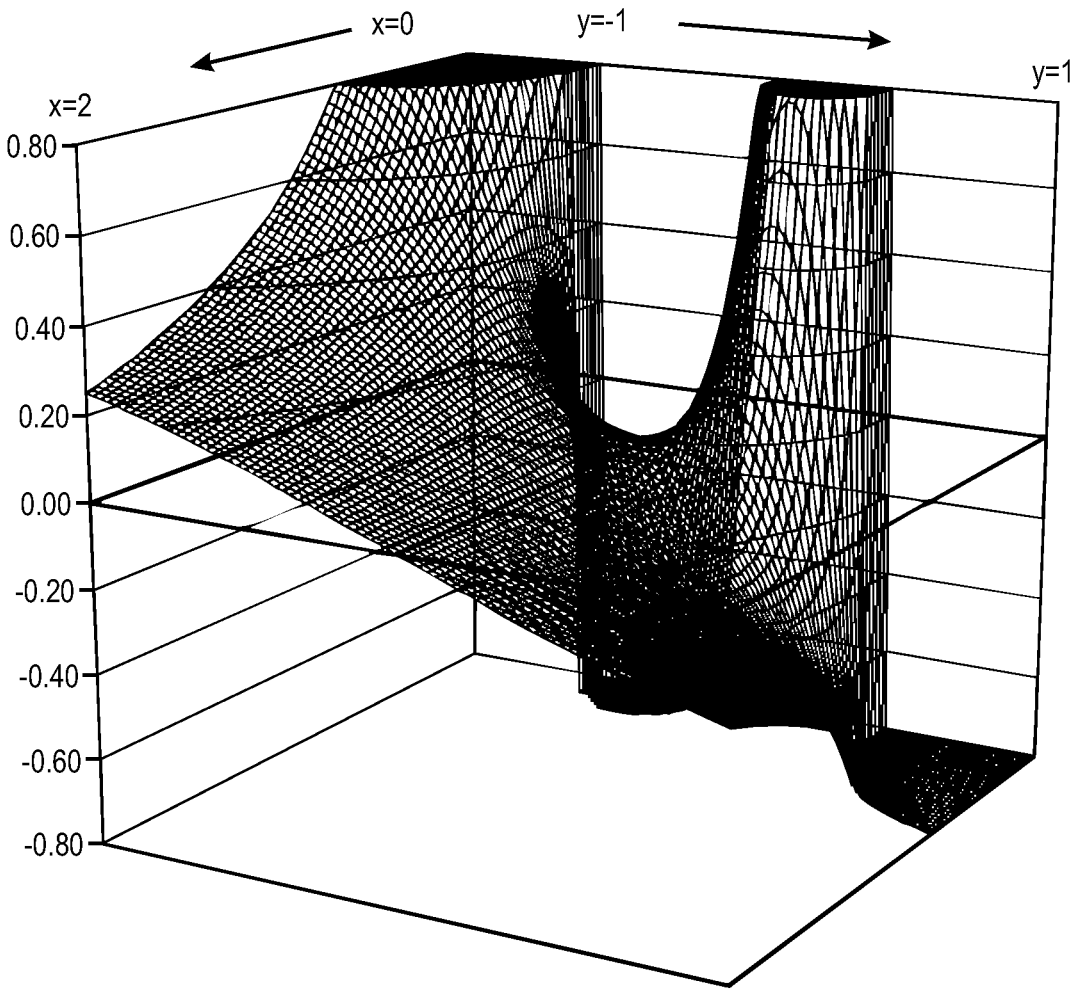
FIGS. 15 and 16 illustrate 3D plots of magnetic field strength in accordance with one embodiment.

FIG. 15 relates to drilling the third well with respect to the first and second wells. Specifically, FIG. 15 includes a 3D plot representing the magnetic field component $B_x$ plotted over the ranges $x\in[0,2]$ and $y\in[-1,1]$. Near (x,y)=(1,0.5), Bx varies in the y-direction, but is relatively constant in the x-direction, i.e.

$$\frac{\partial B_x}{\partial y} >> \frac{\partial B_x}{\partial x}.$$

Hence, measuring $B_x$ indicates the BHA's position along the y-direction. If the measured value for value for $B_x$ differs from the desired value, then it may be desirable for the BHA trajectory to be adjusted as will be described in further detail below.

Figure 16:
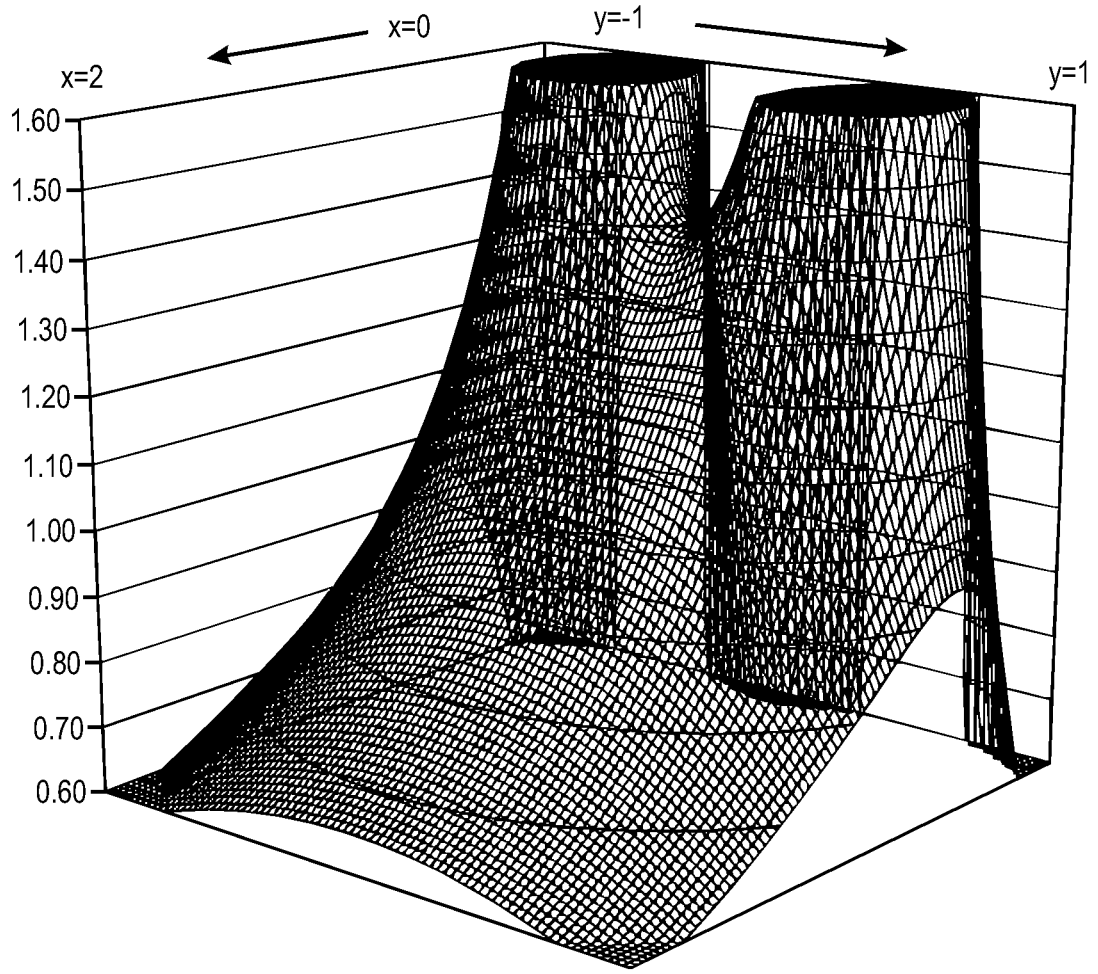

FIG. 16 also relates to drilling the third well with respect to the first and second wells. Specifically, FIG. 16 includes a 3D plot that shows the magnetic field component $B_y$ plotted over the ranges $x\in[0,2]$ and $y\in[-1,1]$. The optimum position for the BHA may be (x,y)=(1,0.5), where By(1,0.5)=1.074 μTesla. As illustrated in FIG. 16, $B_y$ varies mostly in the x-direction, but is relatively constant in the y-direction, i.e.

$$\frac{\partial B_y}{\partial x} >> \frac{\partial B_y}{\partial y}.$$

Thus measuring $B_y$ indicates the BHA's position in the x-direction.

Figure 17:
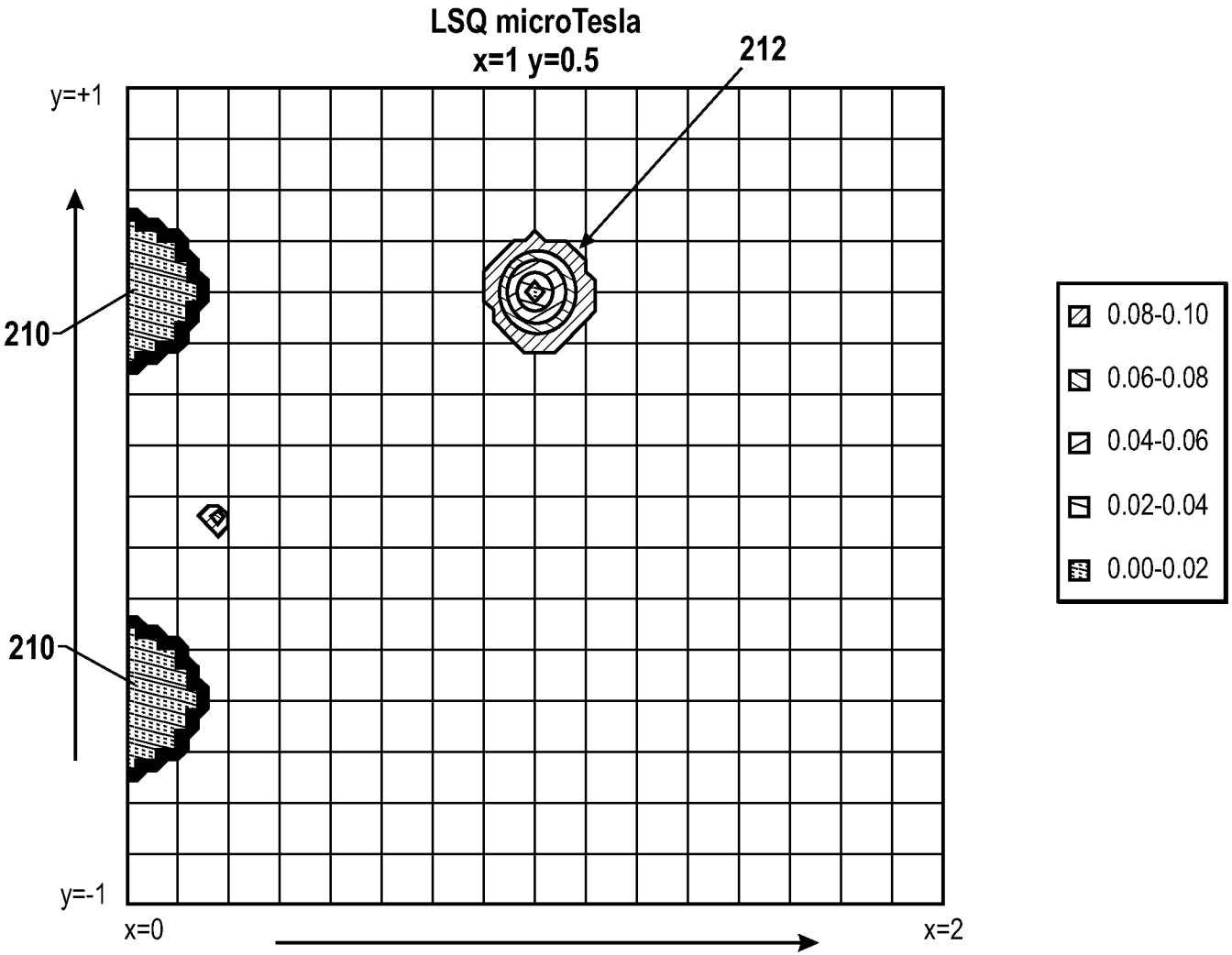
FIG. 17 is a graphic representation of error calculations relating to placement of a bottom hole assembly in accordance with one embodiment.

It should be noted that errors in the magnetic field measurements may produce errors in the estimate of the BHA position. These errors can be quantified as illustrated in FIG. 17. Indeed, FIG. 17 includes a graphical representation that relates to errors in the BHA position while drilling the third well relative to the first and second wells. Specifically, FIG. 17 is a representation of an error estimate for placing the BHA at (x,y)=(1,0.5) for various inaccuracies in the measurement of Bx and By. The effects 210 of the two cased wells are visible along the y-axis, while the target location 212 for the BHA (i.e., the third well location) is indicated by the family of curves located near (x,y)=(1,0.5) m. Each curve indicates the error in position for a given range of errors in $B_x$ and $B_y$. For example, if both magnetic field components have errors of ±0.1 μTesla, then the error in position is ±15 cm. If the magnetic field errors are ±0.06 μTesla, then positional error is ±7.5 cm.

If the BHA is not at the desired position with respect to the existing wells, then the magnetic field components will be different than those predicted by the model. In this case, it may be possible to redirect the BHA to return to the desired position. Let $(x_0,y_0)$ be the desired position, and let the actual position of the BHA be $(x_0+\Delta x,y_0+\Delta y)$. It may be desirable to determine how far to move the BHA, i.e. by $-\Delta x\hat{x}-\Delta y\hat{y}$. The measured magnetic field components are $$B_x(x_0+\Delta x,y_0+\Delta y)\equiv\widetilde{B_x} \text{ and } B_y(x_0+\Delta x,y_0+\Delta y)\equiv\widetilde{B_y}, \tag{7}$$

where $\widetilde{B_x}$ and $\widetilde{B_y}$ are measured values. The magnetic field components at the desired position are $B_x(x_0,y_0)$ and $B_y(x_0,y_0)$. Using a Taylor series expansion, the following two equations may be obtained $$B_x(x_0+\Delta x,\ y_0+\Delta y)=B_x(x_0,\ y_0)+\Delta x\left(\frac{\partial B_x}{\partial x}\right)_{(x_0,y_0)}+\Delta y\left(\frac{\partial B_x}{\partial x}\right)_{(x_0,y_0)} \tag{8}$$

$$B_y(x_0+\Delta x,\ y_0+\Delta y)=B_y(x_0,\ y_0)+\Delta x\left(\frac{\partial B_y}{\partial x}\right)_{(x_0,y_0)}+\Delta y\left(\frac{\partial B_y}{\partial y}\right)_{(x_0,y_0)}, \tag{9}$$

The partial derivatives may be obtained from the theoretical model for the magnetic field. Let $$\Delta B_x=B_x(x_0+\Delta x,y_0+\Delta y)-B_x(x_0,y_0)=\widetilde{B_x}-B_x(x_0,y_0) \tag{10}$$

$$\Delta B_y=B_y(x_0+\Delta x,y_0+\Delta y)-B_y(x_0,y_0)=\widetilde{B_y}-B_y(x_0,y_0). \tag{11}$$

The theoretical values, $B_x(x_0,y_0)$ and $B_y(x_0,y_0)$, may be subtracted from the measured values, $\widetilde{B_x}$ and $\widetilde{B_y}$. Equations (8), (9), (10), and (11) may be inverted to obtain the offsets Δx and Δy, $$\Delta x=\frac{\left(\frac{\partial B_y}{\partial y}\right)\Delta B_x-\left(\frac{\partial B_x}{\partial y}\right)\Delta B_y}{\left(\frac{\partial B_x}{\partial x}\right)\left(\frac{\partial B_y}{\partial y}\right)-\left(\frac{\partial B_x}{\partial y}\right)\left(\frac{\partial B_y}{\partial x}\right)} \text{ and} \tag{12}$$

$$\Delta y=\frac{\left(\frac{\partial B_x}{\partial x}\right)\Delta B_y-\left(\frac{\partial B_y}{\partial x}\right)\Delta B_x}{\left(\frac{\partial B_x}{\partial x}\right)\left(\frac{\partial B_y}{\partial y}\right)-\left(\frac{\partial B_x}{\partial y}\right)\left(\frac{\partial B_y}{\partial x}\right)}. \tag{13}$$

With regard to the example of drilling the third well shown in FIGS. 15 and 16, at $(x_0,y_0)$=(1,0.5), the partial derivatives satisfy $$\frac{\partial B_x}{\partial y}>>\frac{\partial B_x}{\partial x} \text{ and } \frac{\partial B_y}{\partial x}>>\frac{\partial B_y}{\partial y}.$$

Equations (12) and (13) can then be approximated by $$\Delta x\approx-\frac{\Delta B_y}{\left(\frac{\partial B_y}{\partial x}\right)} \text{ and } \Delta y=\frac{\Delta B_x}{\left(\frac{\partial B_x}{\partial y}\right)}.$$

This is the mathematical equivalent of the previous statements concerning the variations of $B_x$ with respect to y and $B_y$ with respect to x. In general, the method may be performed when the gradients $$\vec{\nabla}B_x=\frac{\partial B_x}{\partial x}\hat{x}+\frac{\partial B_x}{\partial y}\hat{y} \text{ and } \vec{\nabla}B_y=\frac{\partial B_y}{\partial x}\hat{x}+\frac{\partial B_y}{\partial y}\hat{y} \tag{14}$$

are large and orthogonal.

Turning now to an example of how to calculate the offsets in the x and y directions for the data shown in FIGS. 15 and 16 using equations (10) to (13). The values for the magnetic field and the partial derivatives may be calculated using the theoretical model described earlier with equations (3) to (6). Let the desired position for the BHA be $(x_0,y_0)$=(1,0.5) m, where $B_x(1,0.5)$=−0.326 μTesla and $B_y(1,0.5)$=1.074 μTesla. The partial derivatives of the magnetic field may be evaluated at the point (1,0.5). They are:

$$\left(\frac{\partial B_x}{\partial x}\right)=0.285\mu\text{Tesla}/m,\ \left(\frac{\partial B_x}{\partial y}\right)=-0.715\mu\text{Tesla}/m,$$

$$\left(\frac{\partial B_y}{\partial x}\right)=-0.790\mu\text{Tesla}/m,\text{ and }\left(\frac{\partial B_y}{\partial y}\right)=-0.295\mu\text{Tesla}/m.$$

Now it may be assumed that the BHA is located at (x,y)=(0.9, 0.6), so that the offset in the x-direction is −10 cm, and the offset in the y-direction is +10 cm. The measured magnetic field components that an actual magnetometer would likely read at the BHA's location are $\widetilde{B_x}=B_x(0.9,0.6)$=−0.440 82 Tesla and $\widetilde{B_y}=B_y(0.9,0.6)$=1.121 μTesla, so that $\Delta B_x$=−0.114 μTesla and $\Delta B_y$=0.047 μTesla. Substituting these values into equations (11) and (12) results in estimated offsets of Δx=−10.4 cm and Δy=11.8 cm. The drill bit would then be steered to move 10.4 cm in the x-direction and −11.8 cm in the y-direction. This theoretical example produces very good results because the gradients $\vec{\nabla}B_x$ and $\vec{\nabla}B_y$ are large and nearly orthogonal at $(x_0,y_0)$=(1,0.5) m. In general, the slot pattern should be designed so that $\vec{\nabla}B_x$ and $\vec{\nabla}B_y$ are large and nearly orthogonal for the best results.

Referring again to FIG. 13, the fourth well in the production platform is drilled with respect to the first and second wells with a geometrical arrangement similar to that for drilling the third well. Hence the magnetic field patterns will be similar to the case just described. Even though the third well is present, it will be screened by the first and second wells, so that only a small current will flow on the casing of the third well. Furthermore, the third well is farther away from the location of the fourth well than the first and second wells. Thus, the effects of the third well are smaller than those of the first and second wells. Accordingly, an exemplary embodiment may treat the third well as essentially negligent in determining the drilling position of the fourth well. However, in one embodiment, a more rigorous model may be utilized and the effects of the third well on the drilling of the fourth well may be determined.

As illustrated in FIG. 13, the fifth well has a different geometric relationship to the existing wells than the previous wells. This is more clearly shown in FIG. 18, which illustrates the geometric relationship of the first four wells to the location of the fifth well. In view of this geometric relationship, the theory may include the first well, the third well, and the fourth well. The second well may be neglected in a simplified analysis because it is screened by the other wells. However, in one embodiment, a more rigorous model may include the effects of all of the existing wells.

Figure 18:
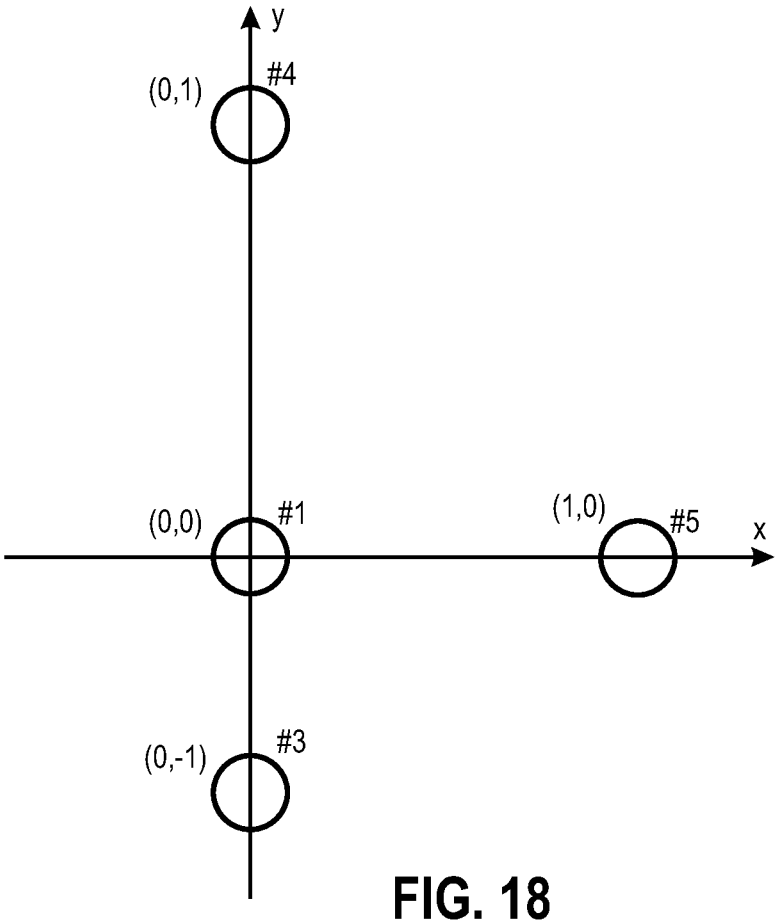
FIG. 18 is a geometric representation of three wells arranged in a pattern with respect to one another in accordance with one embodiment.
Figure 19:
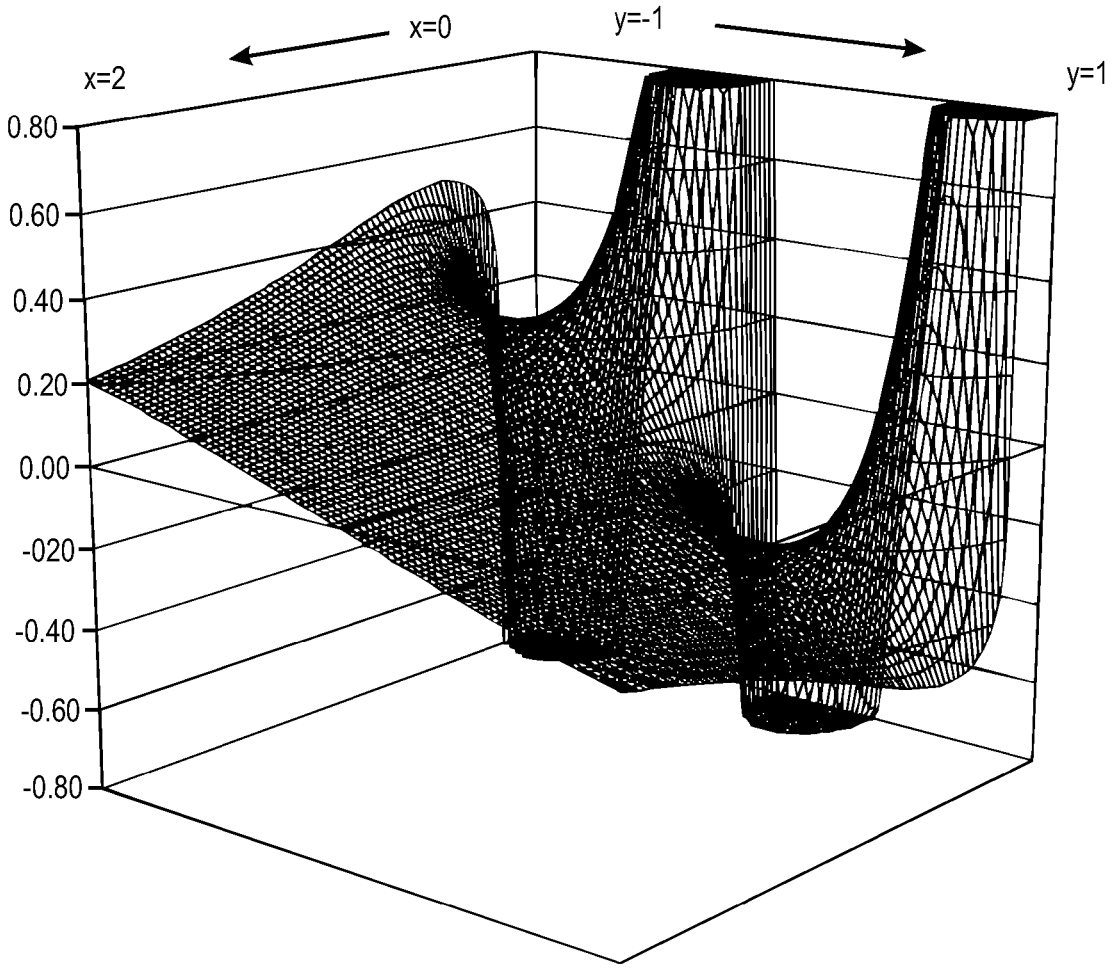
FIGS. 19 and 20 illustrate 3D plots of magnetic field strength in accordance with one embodiment.
Figure 20:
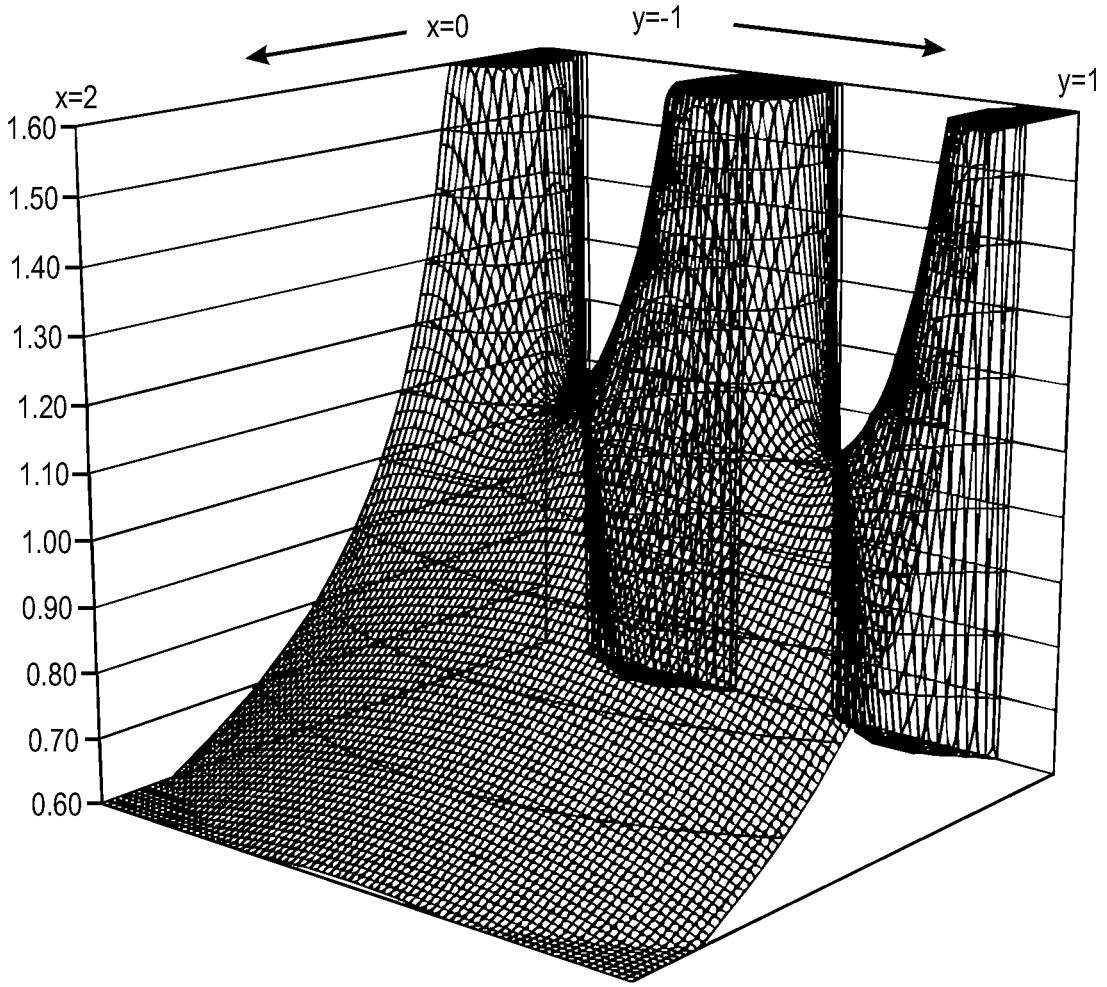

As illustrated in FIG. 18, the first well is at (0,0), the third well is at (0,−1), and the fourth well is at (0,1). Thus, it may be desirable to drill the fifth well at (x,y)=(1,0) m. The modeled results for $B_x$ and $B_y$ are plotted in FIGS. 19 and 20. FIG. 19 includes a 3D plot of $B_x$ over the range $x\epsilon[0,2]$ and $y\epsilon[-1,1]$, wherein the optimum position for the BHA may be (x,y)=(1,0), where $B_x(1,0)=0$ μTesla. FIG. 20 includes a 3D plot of $B_y$ over the range $x\epsilon[0,2]$ and $y\epsilon[-1,1]$, wherein the optimum position for the BHA may be (x,y)=(1,0), where $B_y(1,0)=0.955$ μTesla. As with the previous examples, $B_x$ mostly varies in the y-direction, and $B_y$ varies mostly in the x-direction. At (x,y)=(1,0) m, the model predicts that $B_x(1,0.5)=0$ μTesla and $B_y(1,0.5)=0.955$ μTesla. Maintaining these values may keep the fifth well in the proper location.

Figure 21:
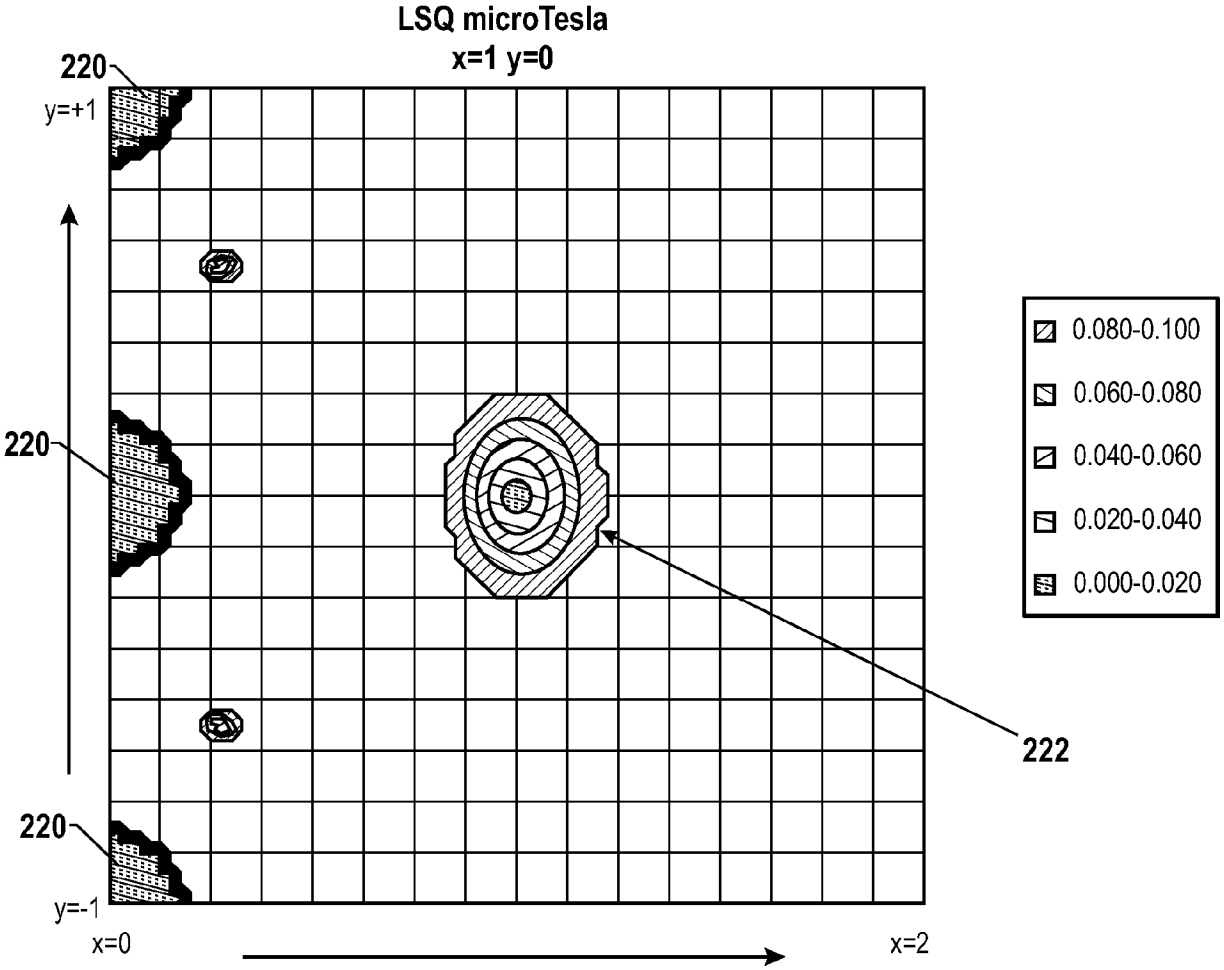
FIG. 21 is a graphic representation of error calculations relating to placement of a bottom hole assembly in accordance with one embodiment.

FIG. 21 represents error in the estimated positioning of the BHA during drilling of the fifth well relative to the first well, the third well, and the fourth well. Such error may be caused by errors in the magnetic field measurements. Specifically, FIG. 21 represents the error estimate for placing the BHA at (x,y)=(1,0) for various inaccuracies in the measurement of $B_x$ and $B_y$. The effects 220 of the three cased wells (i.e., the first, third, and fourth wells) are visible along the y-axis, while the target location 222 for the BHA and placement of the fifth well is indicated by the family of curves located near (x,y)=(1,0) m. Each curve indicates the error in position for a given range of errors in $B_x$ and $B_y$. For example, if both magnetic field components have errors of ±0.1 μTesla, then the error in position is ±20 cm. If the magnetic field errors are ±0.06 μTesla, then the positional error is ±10 cm. Equations (10) to (13) could be used to steer the BHA should it drift away from the desired position.

Figure 22:
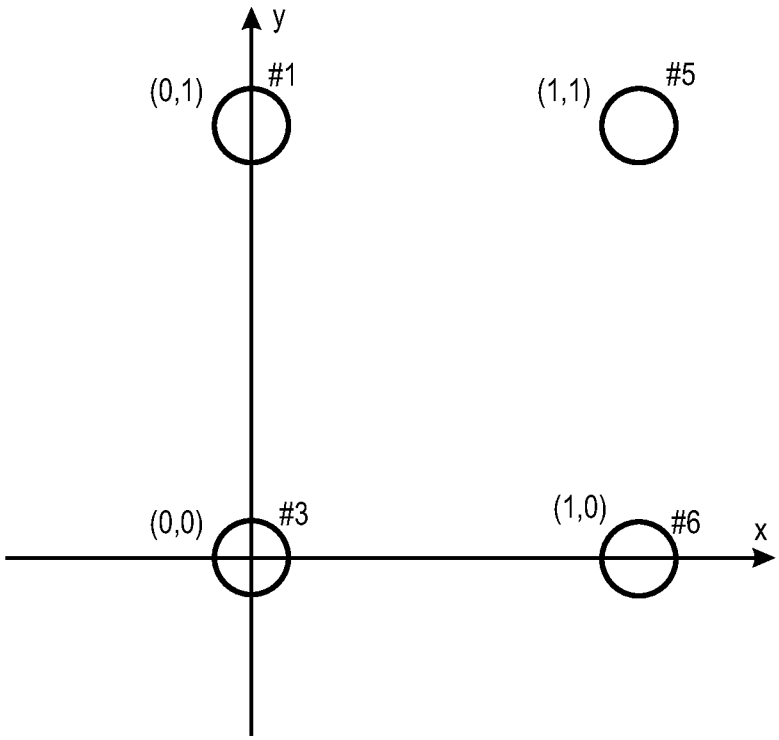
FIG. 22 is a geometric representation of three wells arranged in a pattern in accordance with one embodiment.
Figure 23:
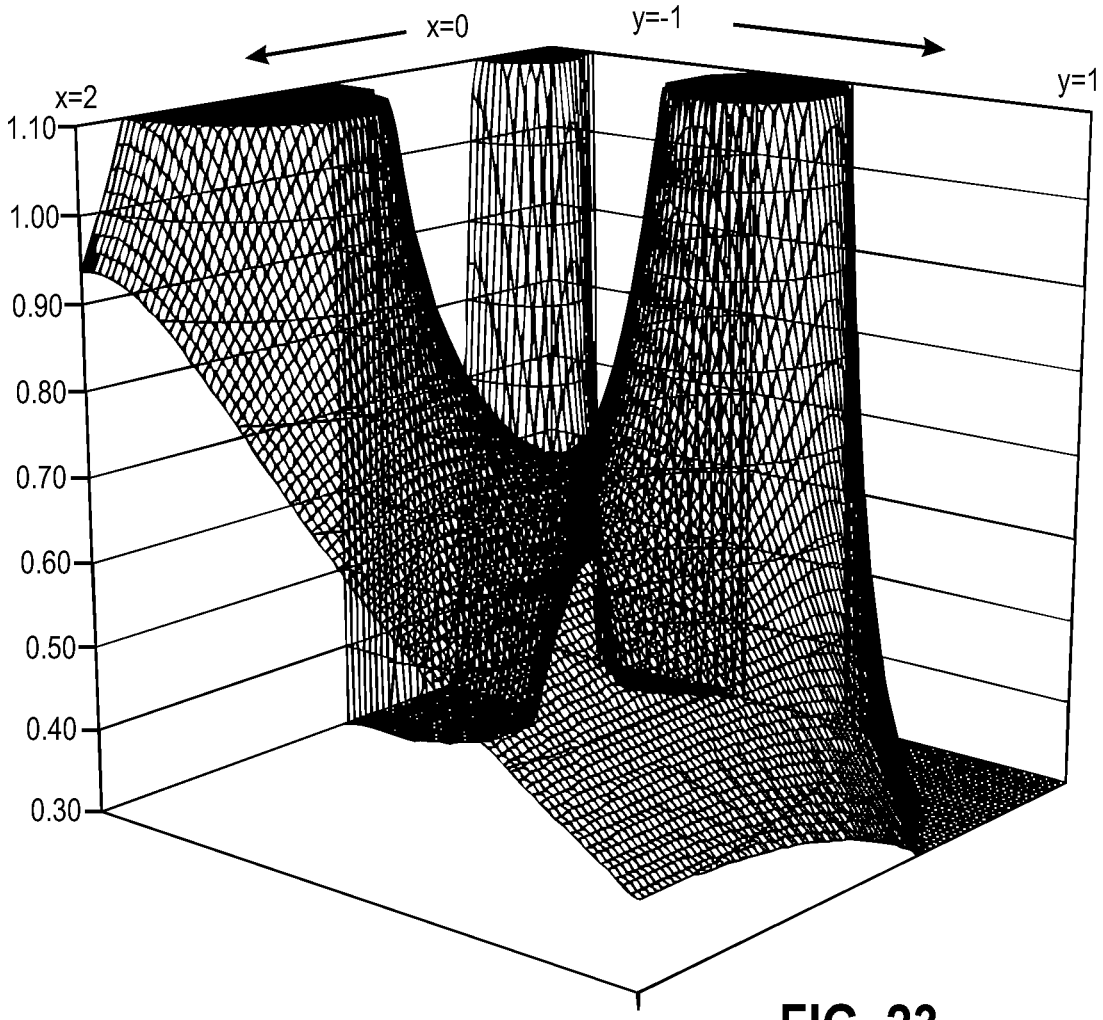
FIGS. 23 and 24 illustrate 3D plots of magnetic field strength in accordance with one embodiment.
Figure 24:
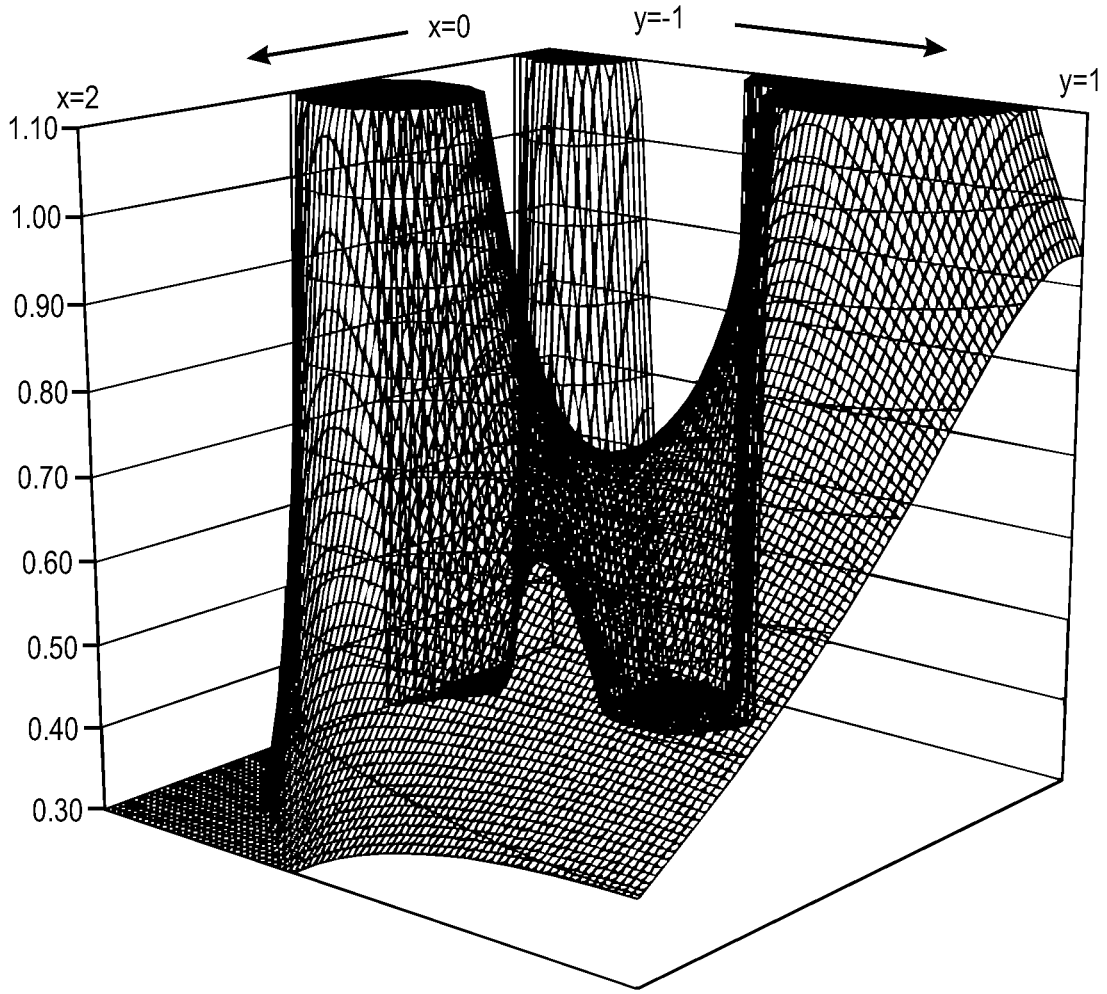

As illustrated in FIG. 13, the sixth well has a different geometric relationship to the existing wells than the previous wells. Indeed, as illustrated in FIG. 13, there is an increased step-out with regard to the positioning of the sixth well relative to the previously described wells. This is more clearly shown in FIG. 22, which illustrates the geometric relationship of the desired location of the sixth well relative to the first well, the second well, and the third. To maintain a square slot pattern, the sixth well may be positioned at $(x_0,y_0)=(1,0)$ m. The model predicts $B_x(1,0)=0.700$ μTesla and $B_y(1,0)=0.700$ μTesla, which may represent optimum positions for the BHA. FIG. 23 shows the magnetic field component $B_x$, and FIG. 24 shows the magnetic field component $B_y$. Both plots cover the ranges $x\epsilon[0,2]$ and $y\epsilon[-1,1]$. In contrast to the previous wells, there are saddle points for both Bx and $B_y$ close to (x,y)=(1,0) m. The gradients $\vec{\nabla}B_x$ and $\vec{\nabla}B_y$ are small near a saddle point, so it becomes more difficult to accurately position a well using magnetic ranging.

Figure 25:
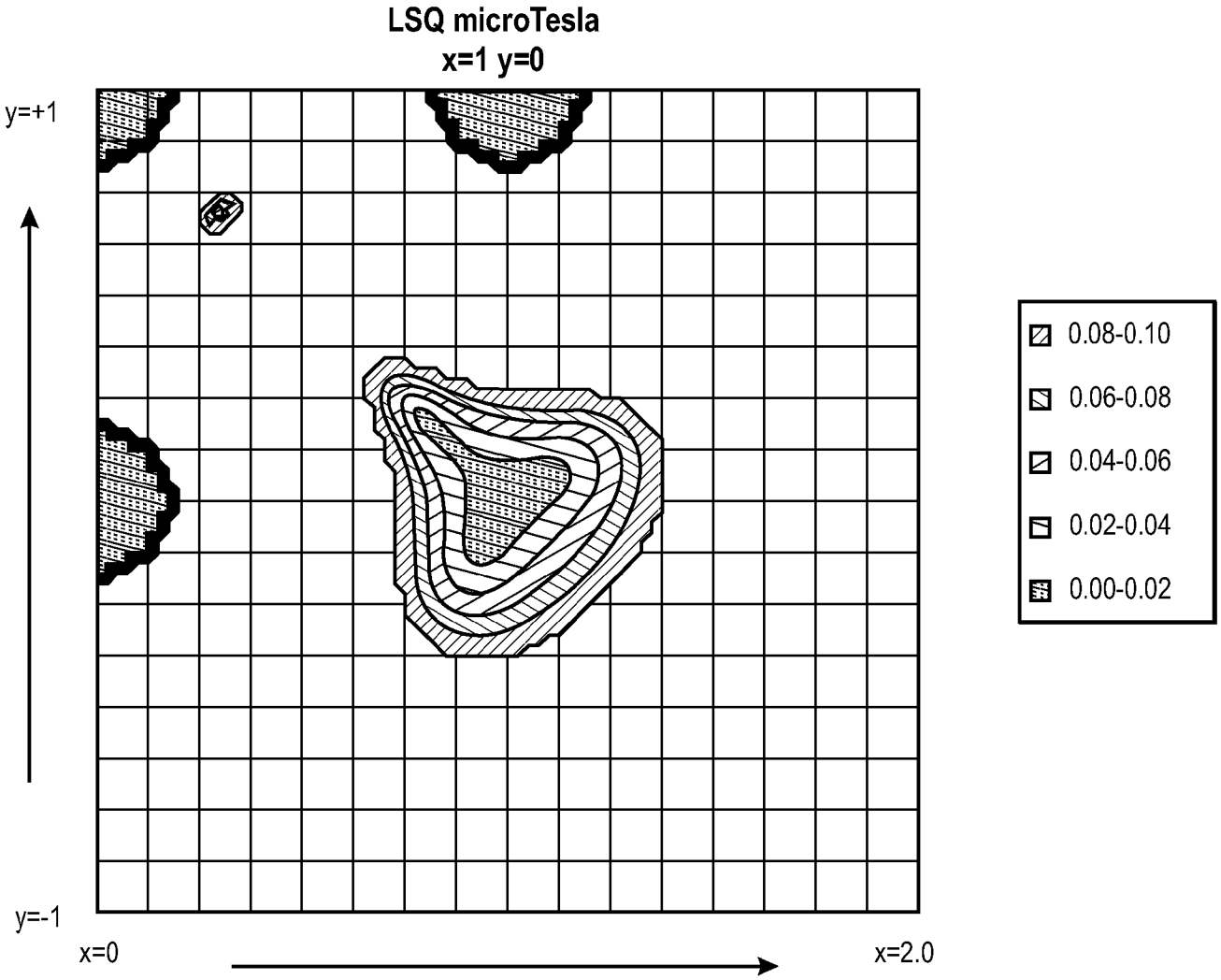
FIGS. 25 and 26 are graphic representations of error calculations relating to placement of a bottom hole assembly in accordance with one embodiment.

This is illustrated in FIG. 25, where the positional errors are plotted versus the uncertainties in the magnetic field components. For magnetic field errors of ±0.1 μTesla, the positional error is ±33 cm. For magnetic field errors of ±0.06 μTesla, the the positional error is only slightly better, being ±29 cm.

Figure 26:
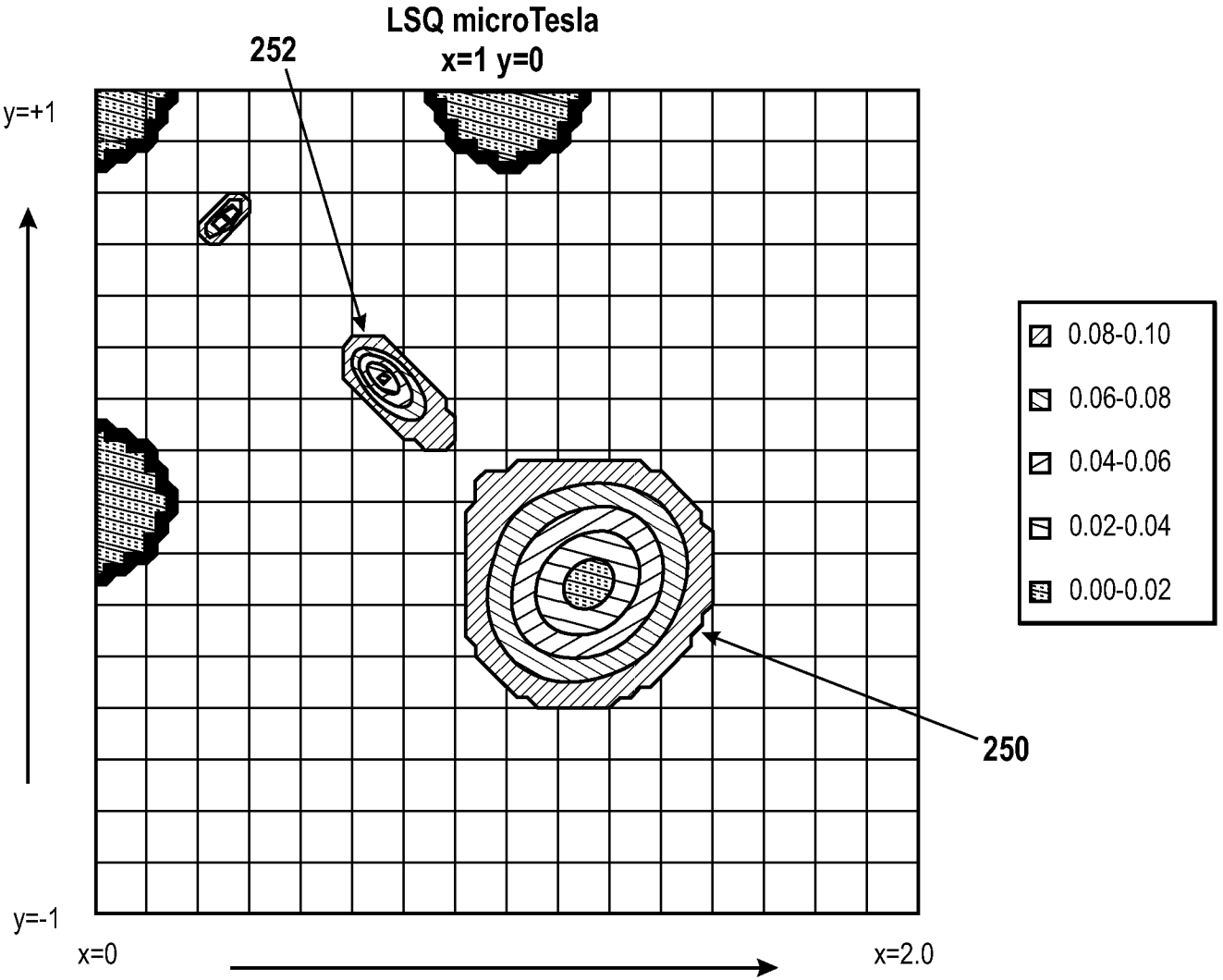

A strategy in accordance with one embodiment may include positioning the sixth well slightly farther from the cased wells, which also places it farther from the saddle points. Rather than locating the sixth well at $(x_0,y_0)=(1,0)$ m, it may be located at $(x_0,y_0)=(1.2,-0.2)$ m. The magnetic field components are $B_x(1.2,-0.20)=0.638$ μTesla and $B_y(1.2,-0.2)=0.638$ μTesla. This results in smaller errors in the position versus measurement errors in the magnetic field. Referring to FIG. 26, the contour lines 250 around $(x_0,y_0)=(1.2,-0.2)$ m indicate the positional errors. For magnetic field errors of ±0.1 μTesla, the positional errors are ±28 cm, and for magnetic field errors of ±0.06 μTesla the positional errors are ±18 cm. It should be noted that there is a second, smaller family of curves 252 located at (x,y)=(0.7,0.3) m. These curves are on the other side of the saddle points and are false. Thus, in drilling the sixth well, it may be desirable not to cross over the saddle points.

Figure 27:
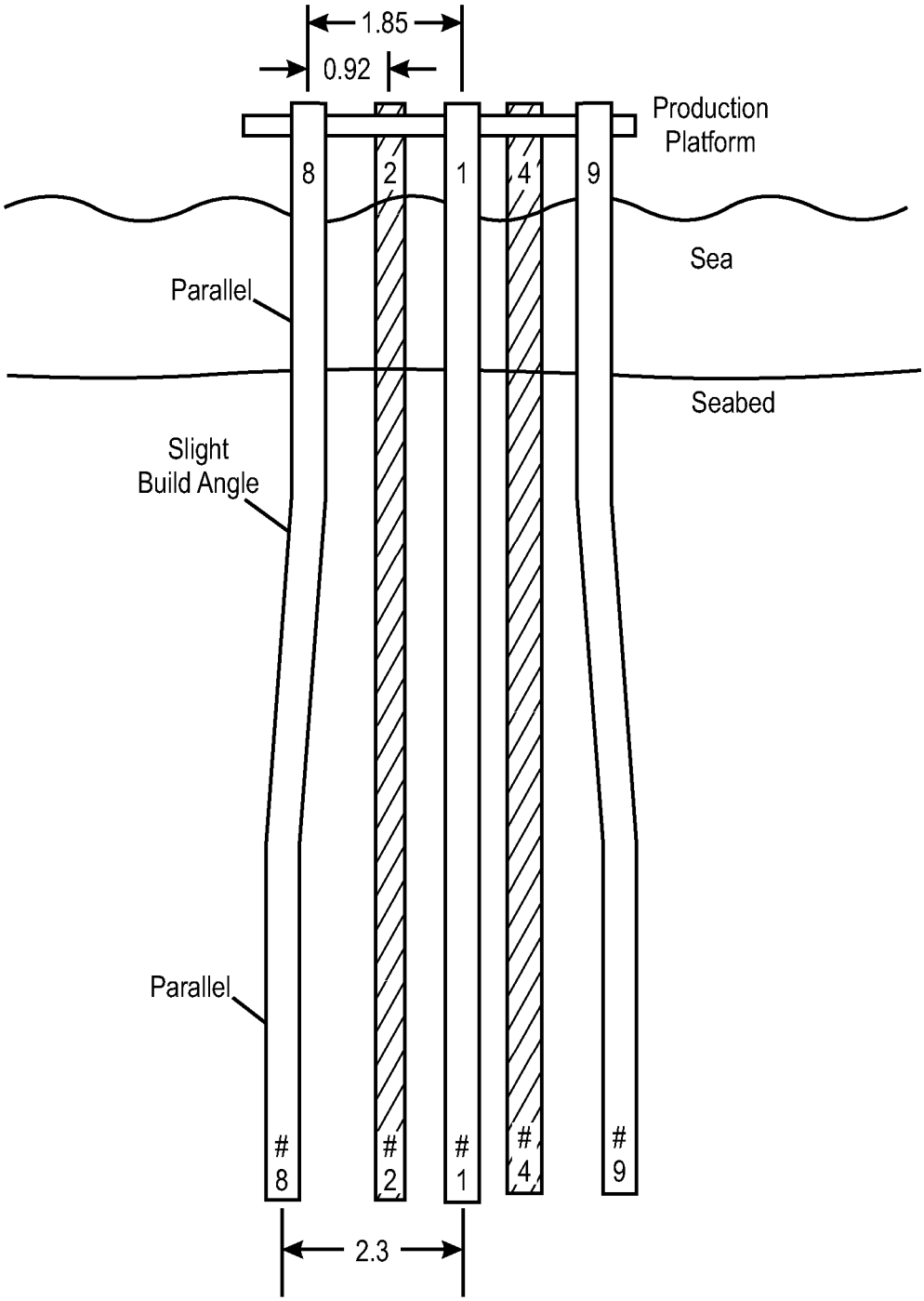
FIG. 27 illustrates a production platform with perimeter wells that may be deviated prior to initiating magnetic ranging while drilling to maintain a substantially parallel orientation relative to other wells in accordance with one embodiment.

With regard to FIG. 13, it should be noted that the outermost wells on the platform can be deviated slightly away from the inner wells to achieve greater separation with depth. This can provide the needed distance from such saddle points as described above for the sixth well. For example, FIG. 27 is a cross-sectional view of the platform of FIG. 13. The cross-section is taken through the center of the platform, and includes the first, eighth and ninth wells, with the second and fourth wells in the background. In the illustrated embodiment, at the platform floor, the first and eighth wells are separated by 1.85 m. The eighth well starts off vertical but then is allowed to deviate slightly away from the first well. Suppose the deviation is 1° for 30 m, then the separation of first well and the eighth well will be 2.3 m, and the wells can continue parallel thereafter. Any well on the perimeter of the platform can be slightly deviated for a short distance before re-establishing a parallel course to the existing wells.

A magnetic ranging method in accordance with one embodiment may also be used to drill a well that is not parallel to the previous wells, but can be used to increase the separation of the drilled well from the existing wells with increased depth, as in the previous example for the first and eighth wells. In general, magnetic ranging can be used to increase or decrease the separation between the BHA and other wells.

Figure 28:
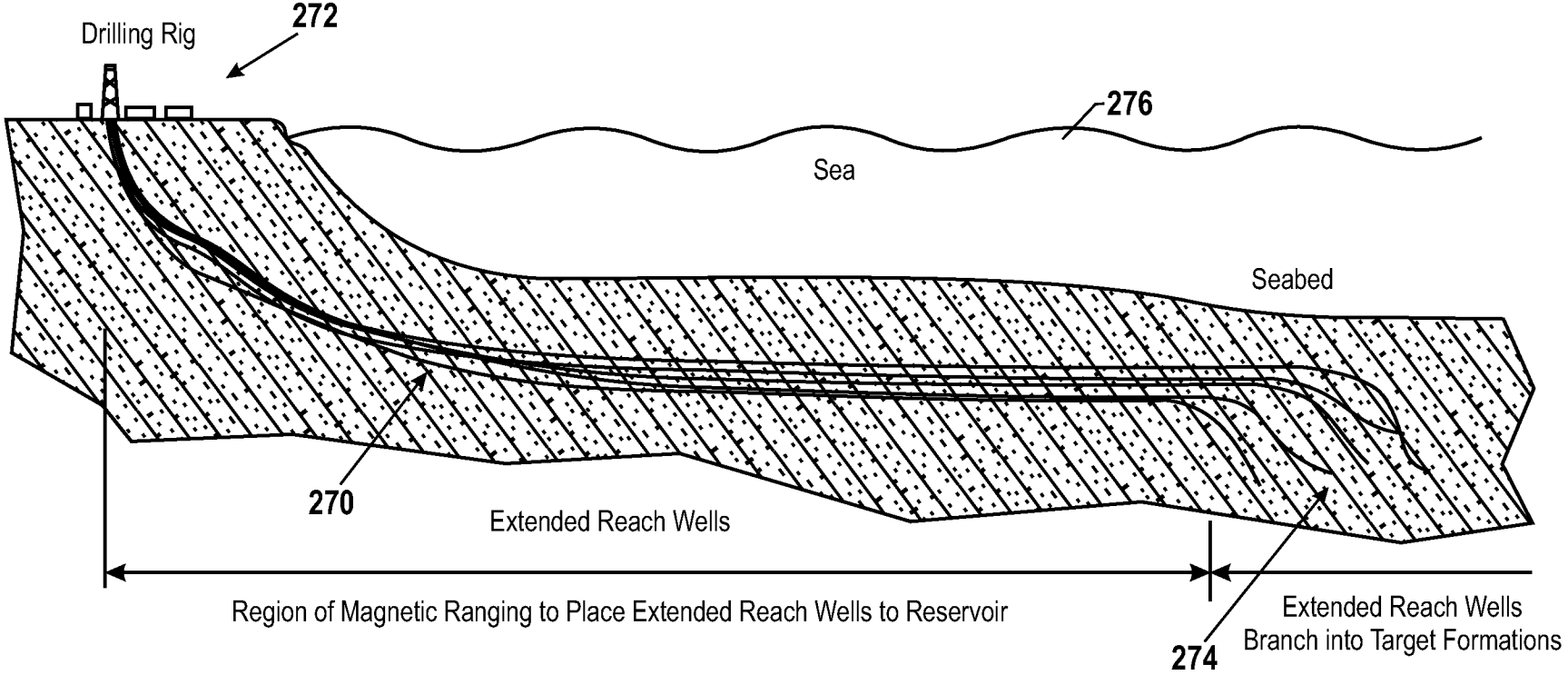
FIG. 28 illustrates extended reach wells drilled from a land rig to reach an offshore reservoir in accordance with one embodiment.

One embodiment may include using magnetic ranging to drill many extended reach wells while reducing the risk of collision. FIG. 28 is a cross-sectional view that illustrates the drilling of many extended reach wells 270 from a rig 272 distant from the reservoir 274. Land rigs, such as the rig 272, may drill several kilometers under a sea 276 to reach an offshore reservoir. In the illustrated example, the wells 270 run in essentially the same direction and at the same depth in the lateral section. Once near the reservoir 274, they may branch out to tap different portions of the reservoir. Owing to the large distance between the rig 272 and the reservoir 274, increasing uncertainty in well position creates the possibility of a collision between a BHA and an existing well if only MWD and D&I measurements are used.

Figure 29:
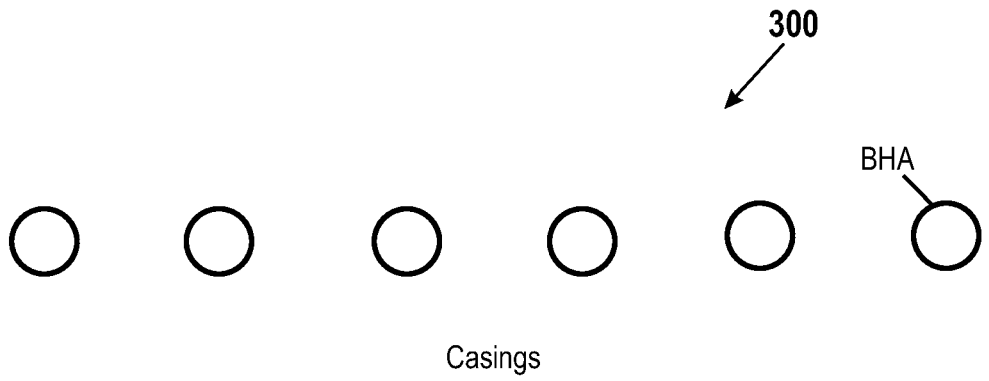
FIG. 29 illustrates a linear pattern for drilling wells in accordance with one embodiment.

In accordance with one embodiment, the first well of the plurality of extended reach wells 270 may be drilled using MWD and D&I, but all subsequent wells may be drilled using magnetic ranging to position the new wells with respect to the existing wells. The wells 270 can be drilled in a triangular pattern, a rectangular pattern, or simply in a linear pattern. For example, a linear pattern 300 in accordance with one embodiment is illustrated in FIG. 29. The new wells can be placed at either end of a horizontal (or vertical) linear arrangement of wells. Since the magnetic ranging does not depend on distance from the rig 272 (i.e. measured depth), the wells 270 can be maintained parallel far from the rig 272.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method for drilling closely spaced wells comprising:

drilling a second well using magnetic ranging to control a distance between the second well and a first well; and drilling a third well using magnetic ranging to control a distance between the third well and the first and second wells, wherein drilling the third well includes drilling the third well with a drilling device, and wherein magnetic ranging includes generating a current along the drilling device, the current flowing through a formation and concentrating on a casing of the first well and a casing of the second well and inducing a magnetic field around each of the first well and the second well.

2. The method of claim 1, comprising drilling the first, second, and third wells in a triangular pattern relative to one another.

3. The method of claim 1, wherein drilling the third well comprises positioning the third well approximately equidistant from the first well and the second well.

4. The method of claim 1, comprising positioning the third well such that the third well is at an apex of an equilateral triangle formed by the first, second, and third wells.

5. The method of claim 1, comprising drilling a fourth well using magnetic ranging to position the fourth well relative to the second and third wells.

6. The method of claim 1, comprising positioning the third well based on the current distributions on casing in each of the first and second wells and a 3D numerical model describing the conductance between long, parallel cylinders.

7. The method of claim 1, wherein:

a center of the third well is located at approximately $\vec{r}_m=(x_m,y_m)$;

a center of the first well is located at approximately $\vec{r}_1=(0,d)$;

a center of the second well is located at approximately $\vec{r}_2=(0,-d)$;

a vector that points from the first well to the third well is defined approximately by the equation $\vec{S}_1=\vec{r}_m-\vec{r}_1=(x_m,y_m-d)$;

a vector that points from the second well to the third well is defined approximately by the equation $\vec{S}_2=\vec{r}_m-\vec{r}_2=(x_m,y_m+d)$; and a distance from the third well to each of the first and second wells is defined approximately by the equations $S_1=\sqrt{x_m^2+(y_m-d)^2}$ and $S_2=\sqrt{x_m^2+(y_m+d)^2}$, respectively, such that the first, second, and third well are substantially equally separated by a distance of approximately $S_1=S_2=2d$.

8. The method of claim 1, comprising positioning the third well relative to the first and second wells using magnetic ranging and a 3D model of a total magnetic field.

9. The method of claim 8, comprising resolving the total magnetic field into two directional components using a measurement of a bottom hole assembly orientation.

10. The method of claim 8, comprising resolving the total magnetic field into two directional components using a measurement of a gyro.

11. The method of claim 1, comprising drilling the second well using magnetic ranging to control a relative direction between the second well and the first well; and drilling a third well using magnetic ranging to control a relative direction between the third well and the first and second wells.

12. The method of claim 1, comprising performing magnetic ranging from casing in one or more of the first well and the second well.

13. The method of claim 1, comprising performing magnetic ranging from drill string in one or more of the first well and the second well.

14. The method of claim 1, comprising drilling additional wells using magnetic ranging while drilling to control the distance between each additional well and the previously drilled wells.

15. A method for drilling a plurality of wells in a triangular arrangement, comprising:

drilling a second well using magnetic ranging to position the second well within a first specified distance and first direction relative to a first well; and drilling a third well using magnetic ranging to position the third well within a second specified distance and second direction relative to the first well, and within a third specified distance and third direction relative to the second well, wherein drilling the third well includes drilling the third well a drilling device, and wherein magnetic ranging includes generating a current along the drilling device, the current flowing through a formation and concentrating on a casing of the first well and a casing of the second well and including a magnetic field around each of the first well and the second well.

16. The method of claim 15, comprising drilling a fourth well using magnetic ranging to position the fourth well within a fourth specified distance and a fourth direction relative to the second well, and within a fifth specified distance and a fifth specified direction relative to the third well.

17. A method of efficiently utilizing available drilling area, comprising:

drilling a second well substantially parallel to a first well for at least a predetermined distance using magnetic ranging; and drilling a third well using a bottom hole assembly such that the third well is substantially parallel to the first and second wells for at least a second predetermined distance using magnetic ranging, wherein the third well is positioned based on a 3D magnetic field model, wherein drilling the third well includes drilling the third well with a drilling device, and wherein magnetic ranging includes generating a current along the drilling device, the current flowing through a formation and concentrating on a casing of the first well and a casing of the second well and inducing a magnetic field around each of the first well and the second well.

18. The method of 17, wherein drilling the third well comprises monitoring differences between magnetic field component values predicted by the 3D magnetic field model and magnetic field component values identified by the bottom hole assembly.

19. The method of claim 18, comprising adjusting the positioning of the bottom hole assembly based on one or more offsets calculated by comparing the magnetic field component values predicted by the 3D magnetic field model and the magnetic field component values identified by the bottom hole assembly.

20. The method of claim 17, comprising locating the third well at approximately an optimum position based on the 3D magnetic field model.

* * * * *